US006206194B1

(12) United States Patent
Beneroff et al.

(10) Patent No.: US 6,206,194 B1
(45) Date of Patent: Mar. 27, 2001

(54) BOXES WITH INTERNAL RESILIENT ELEMENTS AND INSERT THEREFOR

(75) Inventors: Richard N. Beneroff, Chatham; Eric Kim, Secaucus; Jeffrey A. Smith, Clark, all of NJ (US)

(73) Assignee: Motion Design, Inc., Linden, NJ (US)

( * ) Notice: Subject to any disclaimer, the term of this patent is extended or adjusted under 35 U.S.C. 154(b) by 0 days.

(21) Appl. No.: 09/328,700

(22) Filed: Jun. 9, 1999

Related U.S. Application Data

(60) Provisional application No. 60/088,720, filed on Jun. 10, 1998.

(51) Int. Cl.[7] ..... B65D 81/07

(52) U.S. Cl. ..... 206/583; 206/594

(58) Field of Search ..... 206/583, 594, 206/521

(56) References Cited

U.S. PATENT DOCUMENTS

| | | | | |
|---|---|---|---|---|
| Re. 30,098 | | 9/1979 | Titchenal et al. . | |
| 457,390 | | 8/1891 | Weeks . | |
| 1,730,437 | | 10/1929 | Sanderson . | |
| 1,985,075 | | 12/1934 | Bird . | |
| 2,032,386 | | 3/1936 | Wood . | |
| 2,114,422 | | 4/1938 | Guyer . | |
| 2,837,208 | * | 6/1958 | Lingenfelter | 206/583 |
| 2,956,672 | | 10/1960 | Kirkpatrick . | |
| 3,089,590 | | 5/1963 | Mell . | |
| 3,322,263 | | 5/1967 | Gulliver . | |
| 3,456,780 | | 7/1969 | Forman . | |
| 3,507,383 | | 4/1970 | Rorer . | |
| 3,544,007 | | 12/1970 | Bordman . | |
| 3,600,872 | | 8/1971 | Sharpnack, Jr. . | |
| 3,627,116 | | 12/1971 | Cooper . | |
| 3,669,337 | | 6/1972 | Struble . | |
| 3,750,872 | | 8/1973 | Bobb . | |
| 3,752,301 | * | 8/1973 | Bluemel | 206/583 |
| 3,796,307 | | 3/1974 | McKinney . | |
| 3,853,220 | | 12/1974 | Luray . | |

(List continued on next page.)

FOREIGN PATENT DOCUMENTS

| | | | | |
|---|---|---|---|---|
| 638038 | | 3/1962 | (CA) . | |
| 670168 | | 9/1963 | (CA) . | |
| 691904 | | 8/1964 | (CA) . | |
| 0360646 | | 4/1962 | (CH) . | |
| 0969457 | | 6/1958 | (DE) . | |
| 2564068 | | 11/1985 | (FR) . | |
| 2771380 | | 5/1999 | (FR) . | |
| 237322 | | 7/1925 | (GB) . | |
| 904628 | | 8/1962 | (GB) . | |
| 1425746 | | 2/1976 | (GB) . | |
| 1426331 | | 2/1976 | (GB) . | |
| 1561596 | | 2/1980 | (GB) . | |
| 2239854 | | 7/1991 | (GB) . | |
| 49-59982 | | 5/1974 | (JP) . | |
| 49-77087 | | 7/1974 | (JP) . | |
| 50-88376 | | 7/1975 | (JP) . | |
| 50-102778 | | 8/1975 | (JP) . | |
| 50-107583 | | 9/1975 | (JP) . | |
| 57-177969 | | 11/1982 | (JP) . | |
| 3-100158 | | 10/1991 | (JP) . | |
| 0022483 | | 9/1930 | (NL) . | |
| 827346 | * | 5/1981 | (SU) | 206/583 |
| 86/02336 | | 4/1986 | (WO) . | |
| 98/18694 | | 5/1998 | (WO) . | |

*Primary Examiner*—Bryon P. Gehman
(74) *Attorney, Agent, or Firm*—Kenyon & Kenyon

(57) ABSTRACT

A resilient element for a box is provided, wherein the resilient element supports, suspends or holds down an item or items to be shipped. The resilient element may be a part of an insert for the box, wherein the insert comprises the resilient element film attached to one or more panels. The insert may comprise a plastic film glued to a sheet of corrugated cardboard, wherein the sheet of cardboard may be separated into two panels that may be positioned at opposite ends within the box. Alternatively, the resilient element may be directly attached to a box panel.

20 Claims, 36 Drawing Sheets

U.S. PATENT DOCUMENTS

| | | | | |
|---|---|---|---|---|
| 3,905,474 | | 9/1975 | Haibara . | |
| 3,946,870 | | 3/1976 | Gajer et al. . | |
| 4,030,603 | | 6/1977 | Angell . | |
| 4,087,003 | | 5/1978 | Adamek . | |
| 4,180,165 | | 12/1979 | Kuchenbecker . | |
| 4,285,432 | | 8/1981 | de Villers et al. . | |
| 4,306,653 | | 12/1981 | Fales . | |
| 4,307,804 | | 12/1981 | Benham . | |
| 4,328,896 | | 5/1982 | Behne . | |
| 4,488,466 | | 12/1984 | Jones . | |
| 4,606,459 | * | 8/1986 | Luray | 206/583 |
| 4,757,900 | | 7/1988 | Misset et al. . | |
| 4,852,743 | | 8/1989 | Ridgeway . | |
| 4,923,065 | | 5/1990 | Ridgeway . | |
| 5,044,495 | | 9/1991 | Wyslotsky . | |
| 5,056,665 | * | 10/1991 | Boecker et al. | 206/583 |
| 5,071,009 | | 12/1991 | Ridgeway . | |
| 5,086,925 | | 2/1992 | Coalier et al. . | |
| 5,108,803 | | 4/1992 | Kondo et al. . | |
| 5,129,518 | | 7/1992 | Tanaka et al. . | |
| 5,218,510 | | 6/1993 | Bradford . | |
| 5,226,531 | * | 7/1993 | Garwood . | |
| 5,226,592 | * | 7/1993 | Boecker et al. | 206/583 |
| 5,240,111 | | 8/1993 | Yamashita et al. . | |
| 5,251,760 | | 10/1993 | Smith et al. . | |
| 5,259,507 | | 11/1993 | Smith . | |
| 5,287,968 | | 2/1994 | Ridgeway . | |
| 5,323,896 | | 6/1994 | Jones . | |
| 5,388,701 | * | 2/1995 | Ridgeway | 206/583 |
| 5,579,917 | * | 12/1996 | Lofgren et al. | 206/583 |
| 5,669,506 | * | 9/1997 | Lofgren et al. | 206/583 |
| 5,676,245 | | 10/1997 | Jones . | |
| 5,678,695 | | 10/1997 | Ridgeway et al. . | |
| 5,694,744 | | 12/1997 | Jones . | |
| 5,722,541 | * | 3/1998 | Lofgren et al. | 206/583 |
| 5,894,932 | * | 4/1999 | Harding et al. | 206/583 |
| 5,975,307 | * | 11/1999 | Harding et al. | 206/583 |

* cited by examiner

BOXES WITH INTERNAL RESILIENT ELEMENTS AND INSERT THEREFOR

This application claims the benefit of U.S. Provisional Application No. 60/088,720, filed Jun. 10, 1998.

BACKGROUND OF THE INVENTION

The invention relates to packaging in general, and, more particularly, to packaging boxes for accommodating an item or items in a secure manner.

Various packaging boxes are known, including boxes equipped for shipping items in a secure manner. For instance, sensitive items are often shipped in boxes with the items supported on blocks or on specially molded foamed polyurethane, or spaced from the side panels of the box by cardboard inserts, foamed polyurethane pellets or beads, or the so-called bubble-wrap sheets. These protective measures suppress the transmission to the items of impacts, shocks, vibrations and/or other forces to which the box itself may be subjected, but they sometimes are bulky, costly, difficult to handle, environmentally undesirable, and/or are non-compliant or do not conform to the items being shipped.

OBJECT AND SUMMARY OF THE INVENTION

An object of the invention is to provide alternative means for securing items being shipped in packaging boxes.

In accordance with an embodiment of the invention, a resilient element is provided within the box; the resilient element is capable of supporting, suspending and/or holding down an item or items being shipped. Because the resilient element is flexible, it acts as a shock absorber, such that forces on the box are absorbed in whole or in part to reduce or eliminate the transmission of such forces to the items being shipped.

The resilient element may be a part of an insert for placement within the box, wherein the insert provides for the resilient element to extend across a space within the box for supporting, suspending and/or holding down the item or items to be shipped. The insert may comprise one or more panels to which the resilient element is attached.

Alternatively, the resilient element may be directly attached to one or more of the panels of the box itself. For example, the resilient element may be attached to the inside of one or more side panels of the box. The resilient element may additionally be attached to a handle which may be used to twist or otherwise adjust the resilient element in order to secure the item or items in place. A cinching mechanism may also be used to secure the resilient element in place.

The resilient element may take many forms. For example, it may be in the form of a plastic film. Other suitable materials include fabrics, cellulose, rubbers, polymers, and any other material providing the desired pliability, elasticity, and/or flexibility. The shape of the resilient element may be in the form of a sheet, tube, pocket or any other suitable configuration. It may also have additional features, such as slits, holes, or punctures to allow the desired result with respect to the item or items to be secured. For example, a resilient element in the form of a mesh may be used to suspend an item like a hammock. As another example, the resilient element may have a central slit so that it may be looped around an object, with one end of the resilient element being passing through the slit to form the loop.

As a specific example of an insert in accordance with an embodiment of the invention, an insert may comprise a plastic film glued to a rigid sheet of corrugated cardboard or other relatively rigid material, wherein the sheet may be separated into two panels that may be positioned at opposite ends within the box. In such an embodiment, the plastic film extends between the two panels for supporting, suspending and/or holding down the item or items to be shipped.

In accordance with certain embodiments of the invention, the box and the insert may both be constructed so that they may be shipped to the user in a substantially flat condition. For example, the insert may be made of a single flat sheet of corrugated cardboard, with the plastic film glued in at least two places to the flat sheet. For use, the sheet of cardboard may be separated into two panels, with the plastic film glued to each of the panels so that it extends between them.

DETAILED DESCRIPTION OF THE ILLUSTRATIVE EMBODIMENTS

Figure 1:
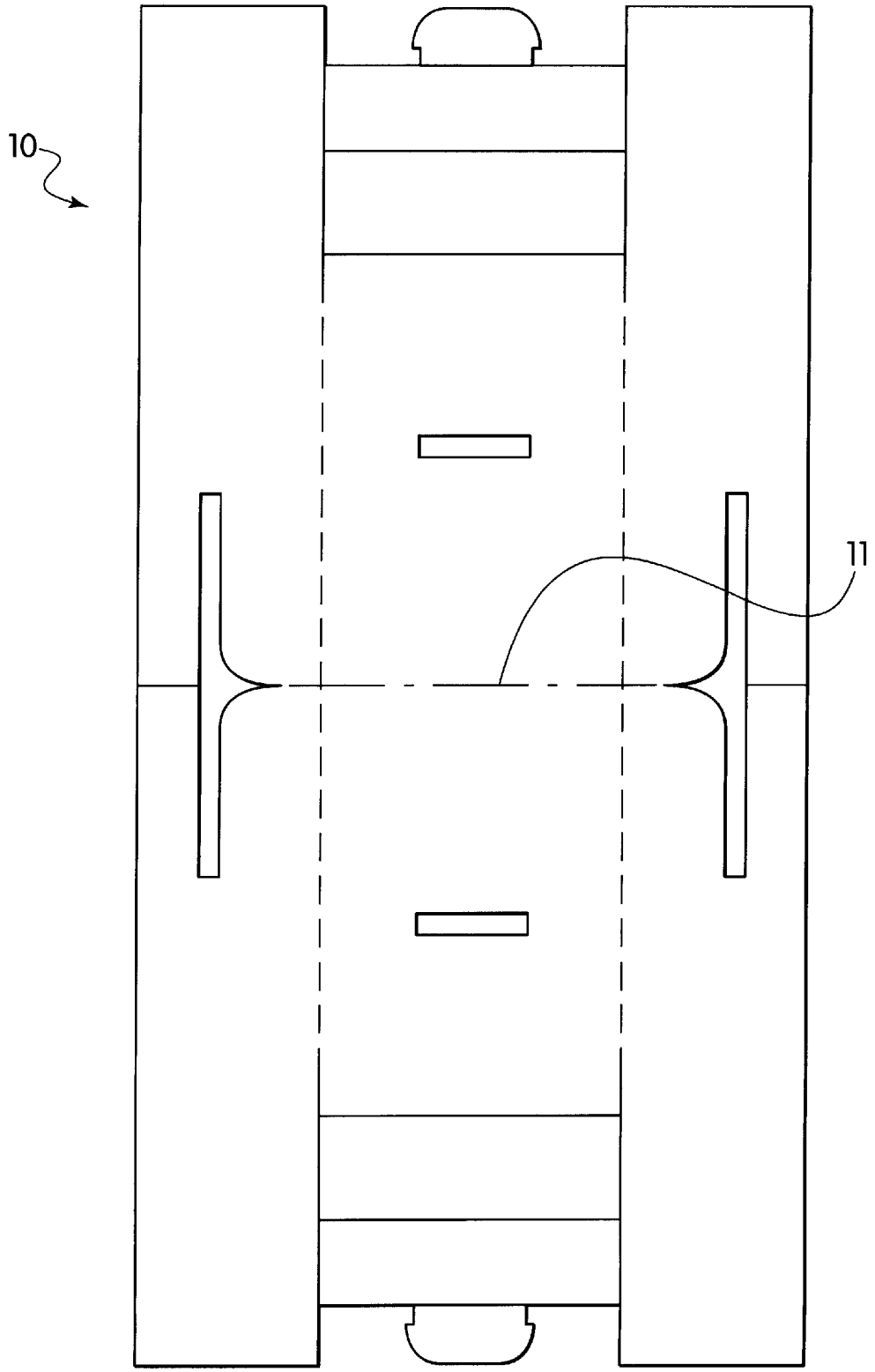
FIG. 1 shows a sheet portion of an insert in accordance with a first embodiment of the invention.

FIG. 1 shows a sheet 10 for an insert in accordance with a first embodiment of the invention. The sheet 10 may be constructed, for example, of corrugated cardboard of any other suitable material. The sheet has a score line 11 along which the sheet may be separated. The score line may be formed, for example, of a cut that extends completely through the material in all but a few places, and most of the way through the material in the remaining places, or in any other suitable manner as will be appreciated by persons of ordinary skill in the art.

Figure 2:
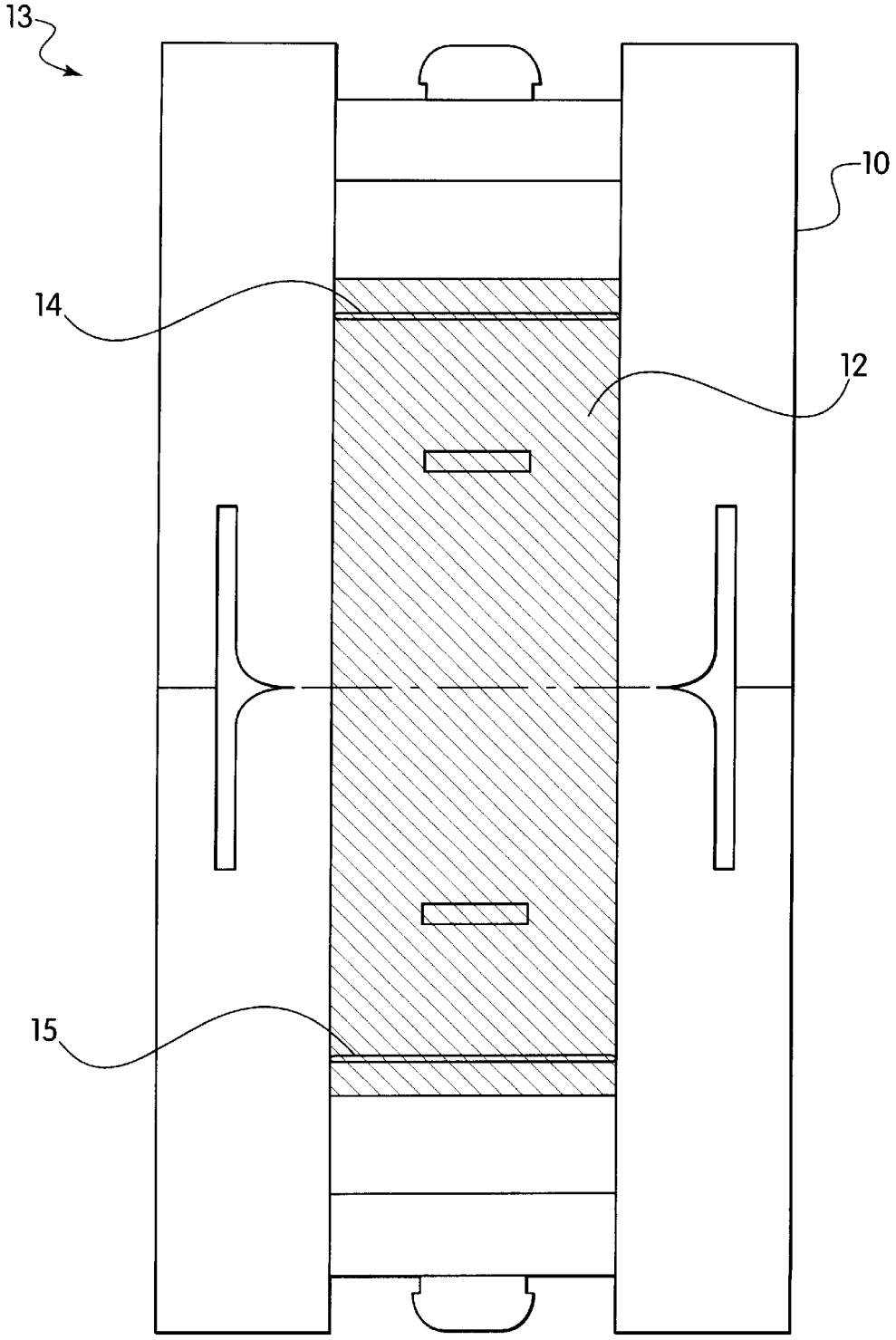
FIG. 2 shows the sheet of FIG. 1, with plastic film glued to the sheet, forming the completed insert.

FIG. 2 shows the sheet 10 of FIG. 1, with a resilient element 12 attached to the sheet 10, forming the completed insert 13. In this illustrated embodiment, the resilient element 12 is a plastic film, although any suitable material or configuration may be used. In this illustrated embodiment, the plastic film is attached to the sheet 10 by two glue beads or lines 14, 15, although attachment may be accomplished in any other suitable manner.

Figure 3:
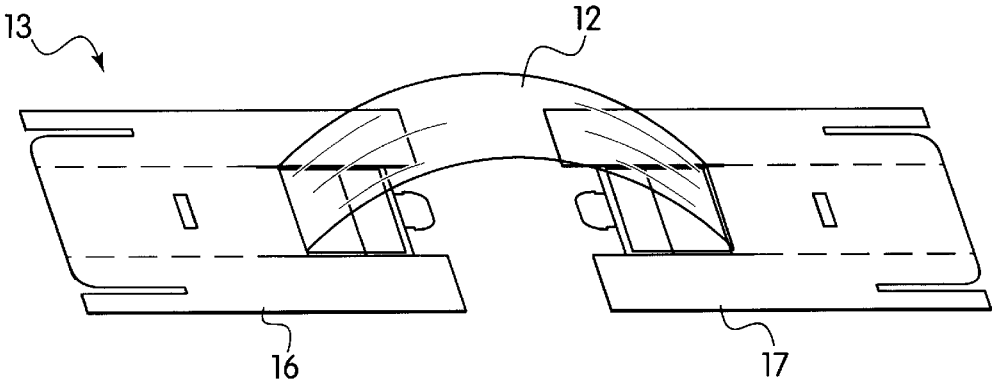
FIG. 3 shows the insert of FIG. 2, with the sheet portion separated to form two panels.

FIG. 3 shows the insert 13 of FIG. 2, with the sheet portion now separated along the score line 11 to form two panels 16, 17. The score line 11 facilitates easy separation of the sheet 10 into the panels 16, 17. Because the plastic film 12 is glued to each of the panels 16, 17, it extends between the panels 16, 17 when they are separated.

Figure 4:
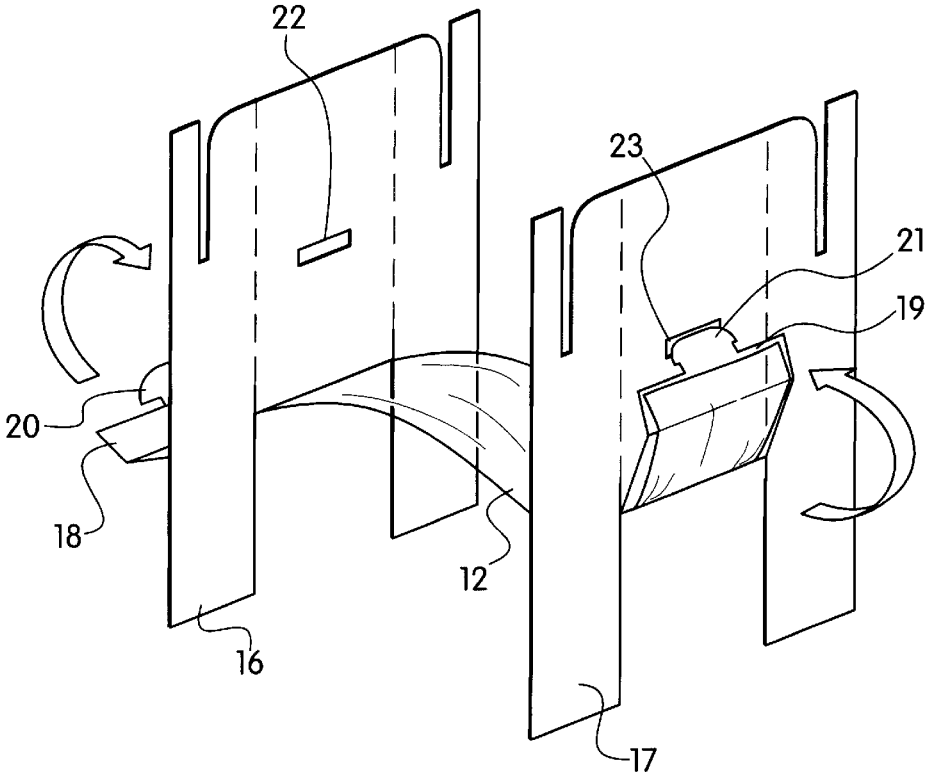
FIG. 4 shows the insert of FIG. 2, with the plastic film being positioned.

FIG. 4 shows the insert 13 of FIG. 2, with the plastic film 12 being positioned, as well as tensioned, by the folding of flaps 18, 19. With the panels 16, 17 facing each other, the flaps 18, 19 to which the plastic film 12 is attached are folded outwardly, away from the central area between the two panels 16, 17. A tab 20, 21 on each flap 18, 19, is then inserted into a respective slot 22, 23 in the panels 16, 17. In this manner, the plastic film 12 may be tensioned between the two panels 16, 17.

Figure 5:
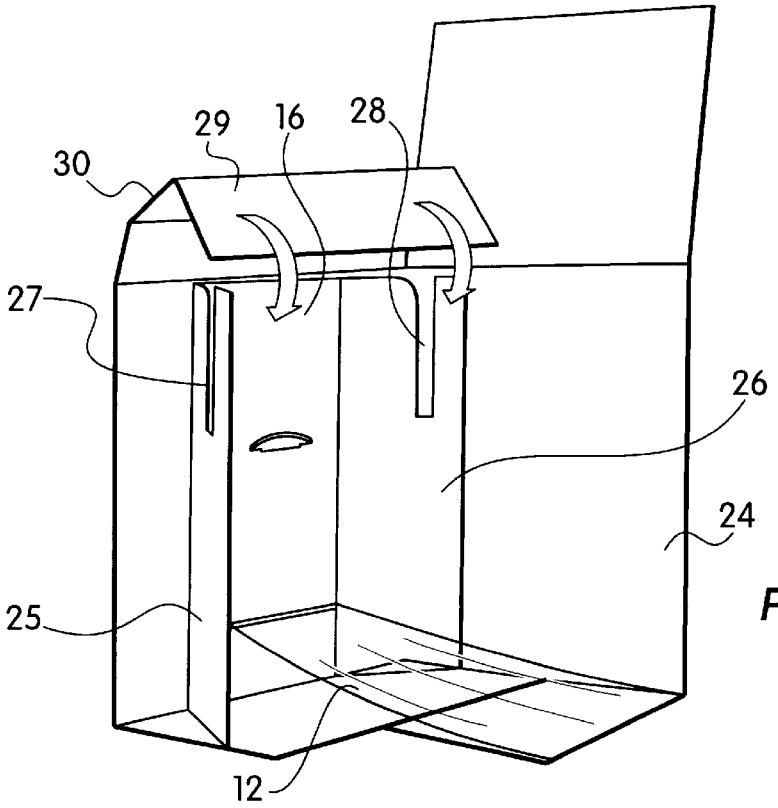
FIG. 5 shows a cutaway view of a box with the insert of FIG. 2 positioned within the box, showing one panel of the insert.
Figure 6:
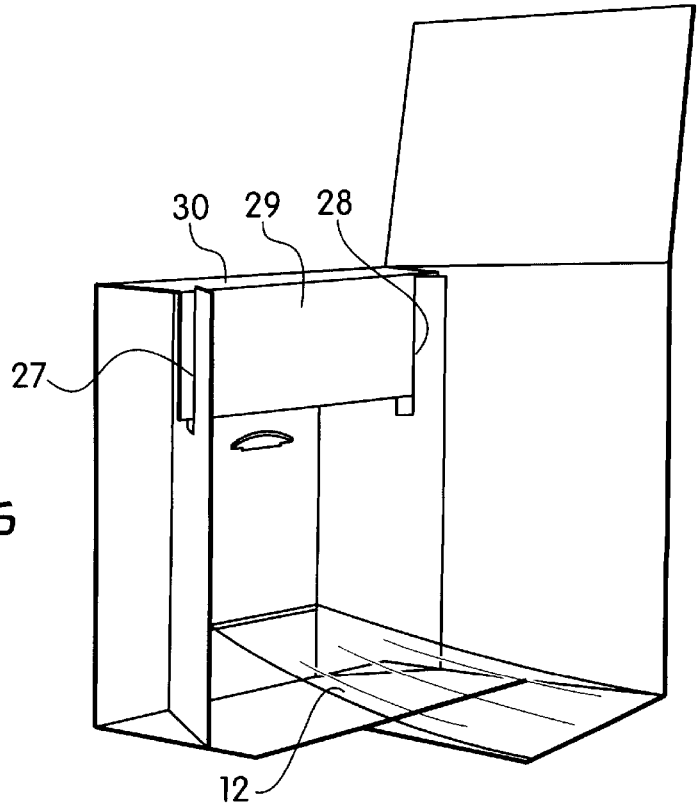
FIG. 6 shows a view similar to FIG. 5, with the lid of the box folded downward into slots in the insert to hold the insert in position.

FIG. 5 shows a cutaway view of a box 24 with the insert 13 of FIG. 2 positioned within the box 24, showing one panel 16 of the insert 13. The panel 16 is wider than the box 24, such that the side panels 25 and 26 must be folded at angles in order that the central portion of the panel 16 may be positioned against the side of the box. The side panels 25, 26 help keep the panel 16 in position. The side panels 25, 26 have lid receiving slots 27, 28 for receiving a retaining flap 29 on the lid of the box 24. FIG. 6 shows a view similar to FIG. 5, with the retaining flap 29 of the lid of the box 24 shown folded downward into the receiving slots 27, 28 of the insert 13.

Figure 7:
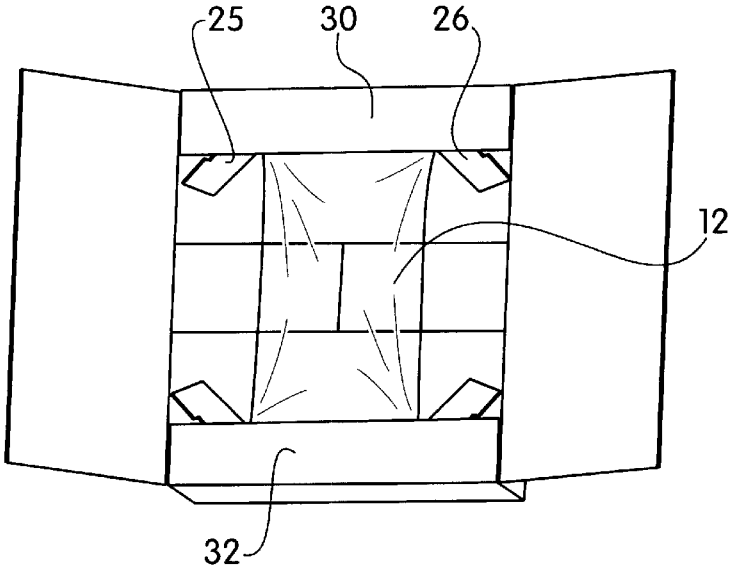
FIG. 7 shows a top view of the box of FIG. 5 with the insert in place and the lid of the box folded downward.
Figure 8:
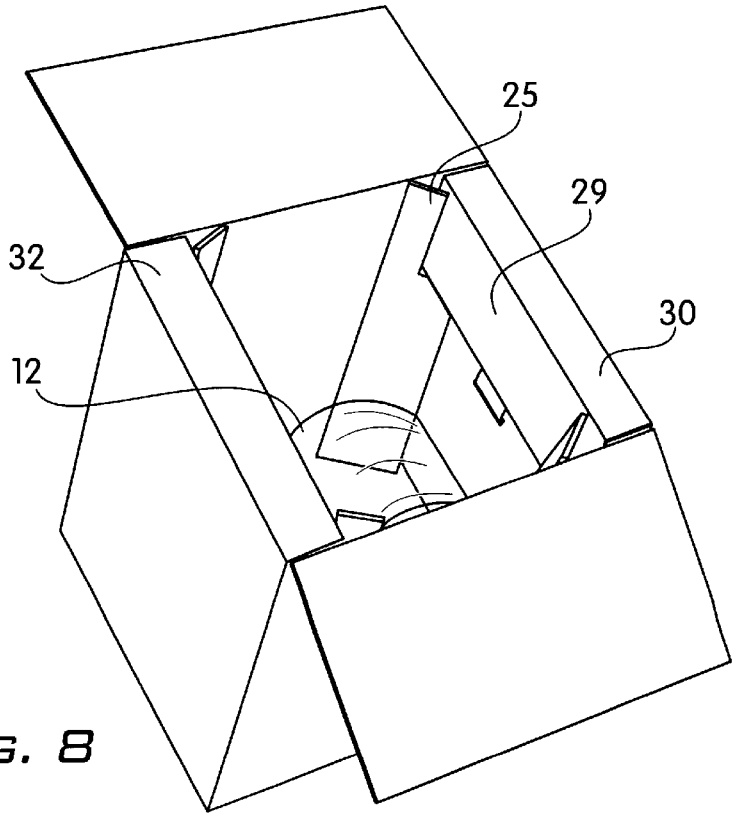
FIG. 8 shows a perspective view of the box of FIG. 5 with the insert in place and the lid of the box folded downward, showing the inside of the box.

The other panel 17 is positioned at an opposite end of the box in a manner similar to panel 16. FIG. 7 shows a top view of the box 24 of FIG. 5 with the insert 13 in place and the lid of the box folded downward. Lid flaps 30 and 32 are visible in this view and partially obstruct the view of the panels 16, 17 of the insert 13. FIG. 8 shows a perspective view of the box of FIG. 5 with the insert 13 in place and the lid of the box folded downward, showing the inside of the box.

Figure 9:
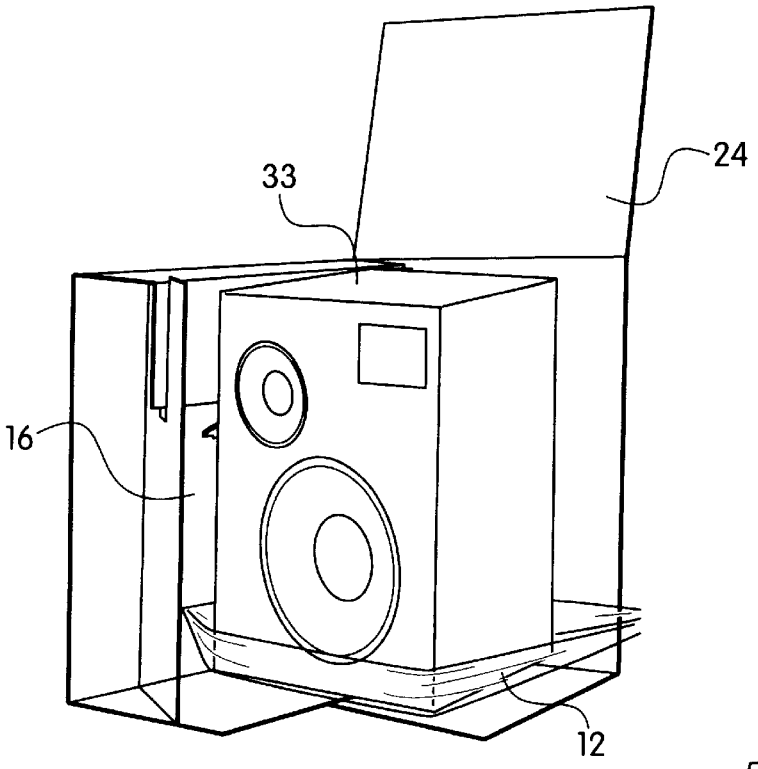
FIG. 9 shows a view similar to FIG. 6, with an item being supported by the plastic film.
Figure 10:
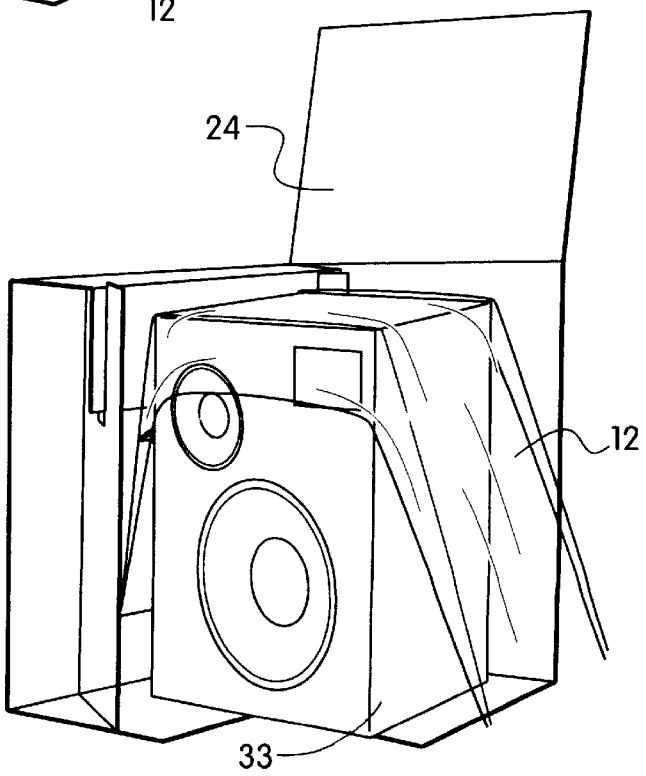
FIG. 10 shows a view similar to FIG. 6, with an item being held down by the plastic film.

FIGS. 9 and 10 show how the insert is used to support or hold down an item 33 to be shipped. As shown in FIG. 9, the insert 13 may be placed in the box 24 with the plastic film 12 extending across the box, near the bottom of the box but separated from the bottom of the box. The item 33 is placed in the box and is supported by the plastic film 12, such that it is suspended from the bottom of the box. Alternatively or additionally, as shown in FIG. 10, the item 33 may be placed in the box and then insert 13 may be positioned in the box such that the plastic film 12 lies over the top of the item 33 to hold the item down. In this manner, the plastic film 12 secures the item 33 and keeps the item 33 distanced from the top of the box.

Persons of ordinary skill in the art will appreciate that using an insert in accordance with the invention, in which a resilient element is used to support, suspend and/or hold down an item being shipped, is useful in securing the item during shipping. The insert secures the item in place, and the resiliency of the resilient element helps absorb shock. The resilient element also distances the item away from sides of the box, which may be subject to puncture or other damage. In addition, because of the flexibility of the resilient element, it is able to conform substantially to the item or items being shipped, which is especially useful for items having odd-shaped configurations. Also, certain configurations of resilient elements in accordance with the invention, for example those with slits or holes or those in the form of a pocket, allow protrusions from the item to project and to be suspended, thereby protecting such protrusion, which may be fragile.

Figure 10B:
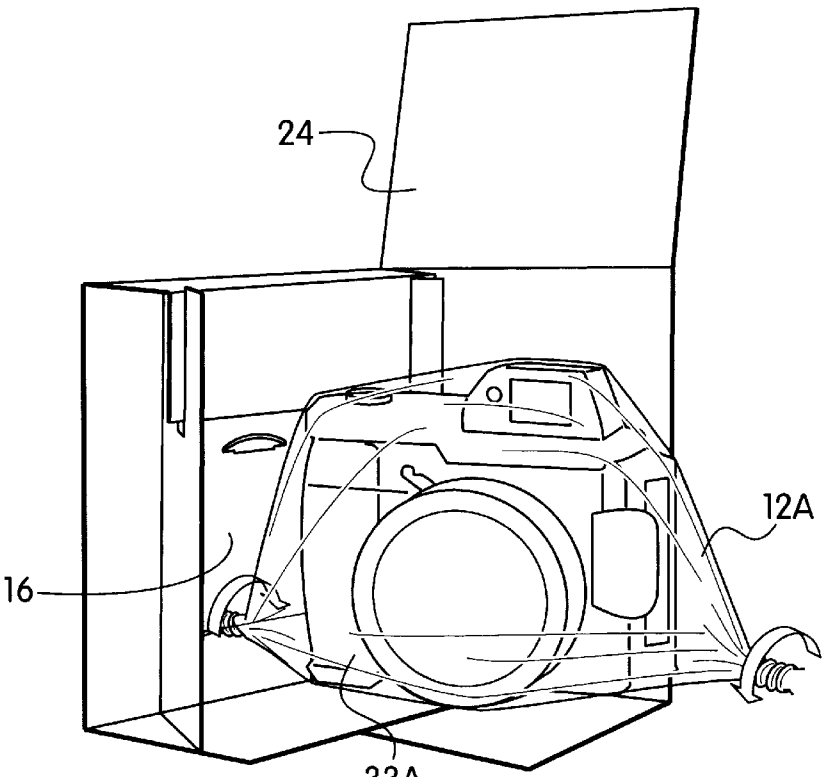
FIG. 10B shows the box of FIG. 10A, with the resilient element being twisted to further support the item to be shipped.
Figure 10A:
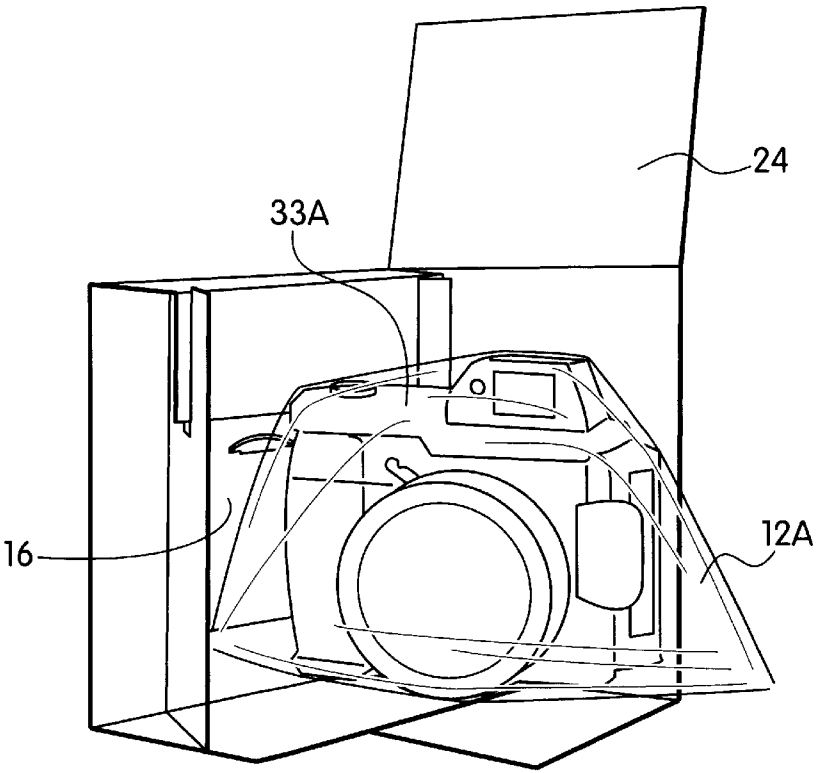
FIG. 10A shows a view similar to FIG. 10, with an alternative configuration of a resilient element.

FIGS. 10A and 10B show a view similar to FIG. 10, with an alternative configuration of a resilient element. In this embodiment, the resilient element 12A may be in the form of a pocket or in the form of a tube with a slit in it, allowing an item 33A to be placed inside the pocket or tube. This assists in securing the item for support and suspension. As shown in FIG. 10B, the item 33A may be more tightly secured in the resilient element by twisting the resilient element 12A. Tightening may be accomplished in other suitable ways, for example, by cinching the resilient element.

Figure 11:
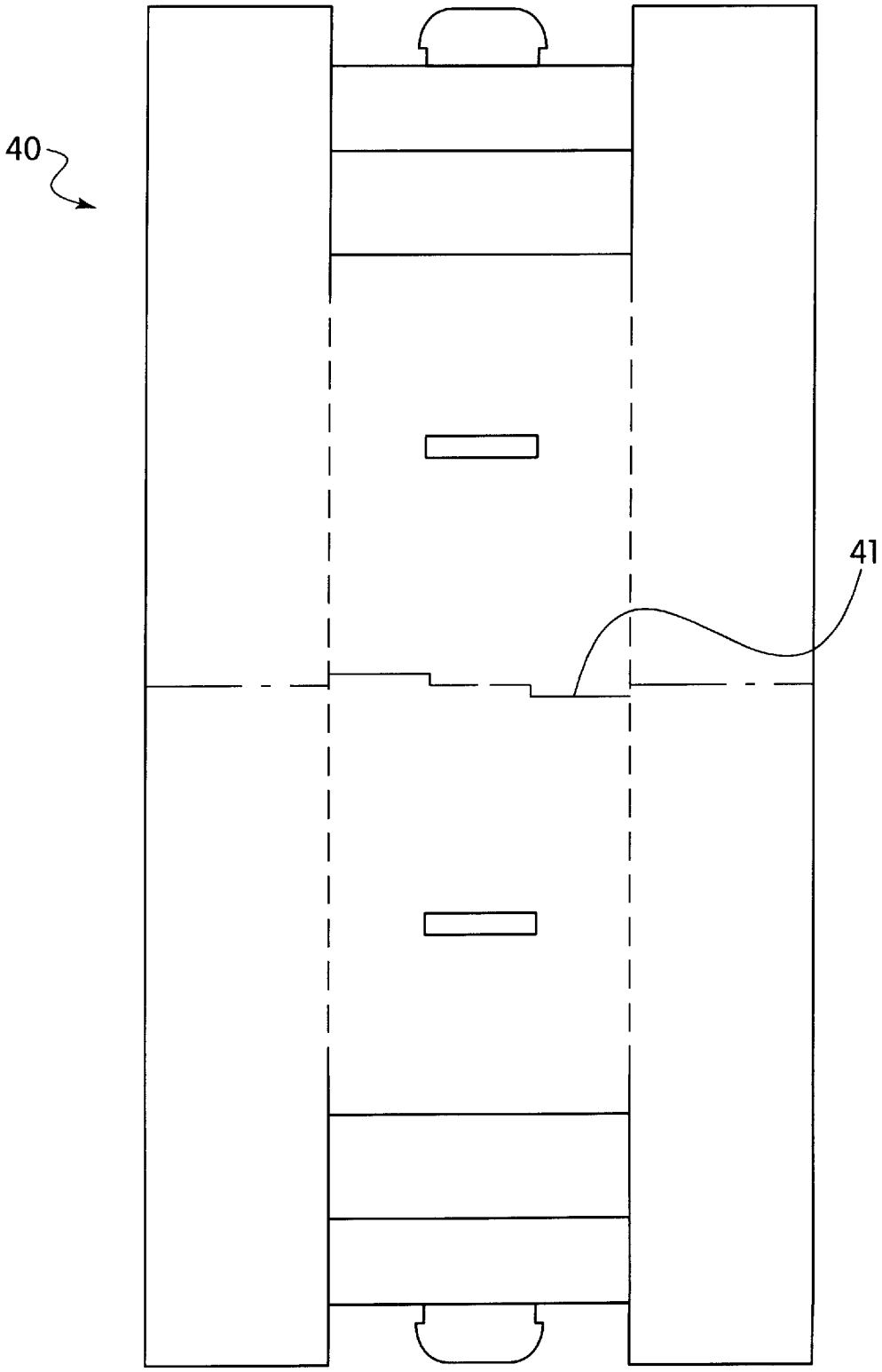
FIG. 11 shows a sheet portion of an insert in accordance with a second embodiment of the invention.
Figure 12:
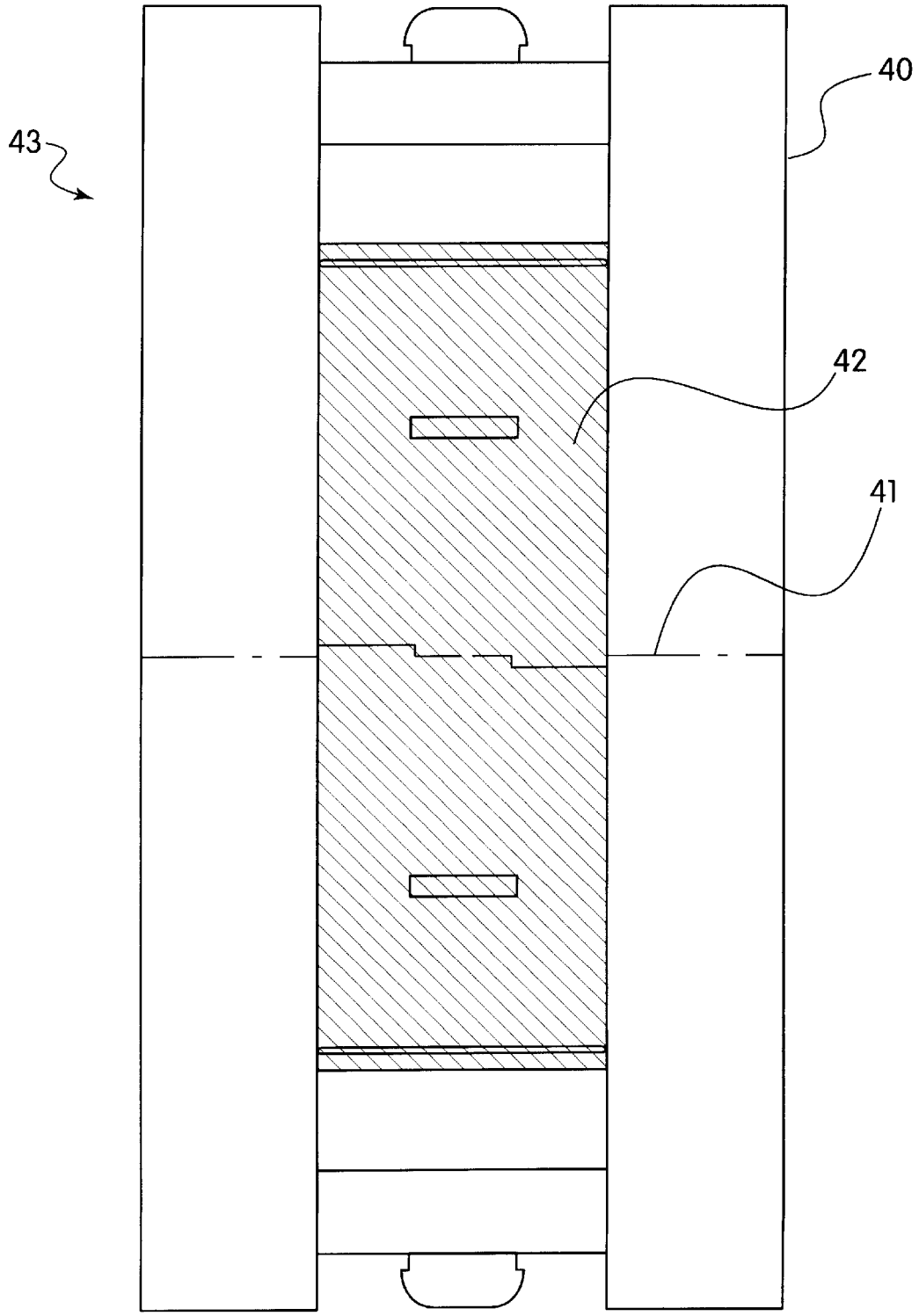
FIG. 12 shows the sheet of FIG. 11, with plastic film glued to the sheet, forming the completed insert.

FIG. 11 shows a sheet 40 for an insert 43 in accordance with a second embodiment of the invention. FIG. 12 shows the sheet 40 of FIG. 11, with plastic film 42 glued to the sheet, forming the completed insert 43.

Figure 13:
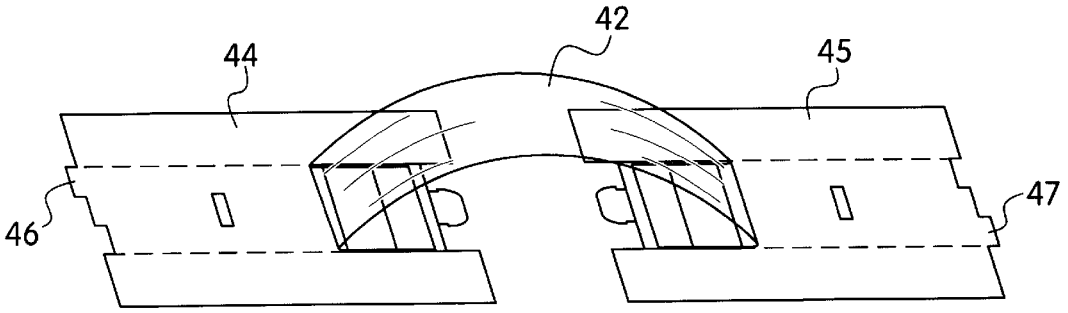
FIG. 13 shows the insert of FIG. 12, with the sheet portion separated to form two panels.
Figure 14:
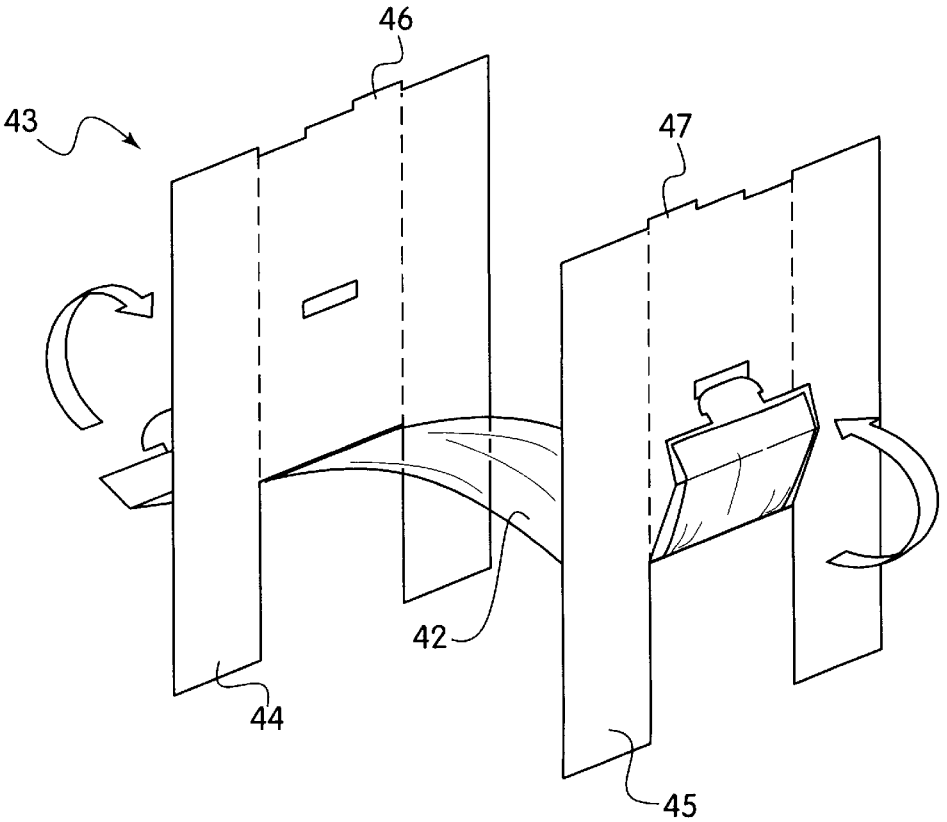
FIG. 14 shows the insert of FIG. 12, with the plastic film being positioned.

FIGS. 13 and 14 shows the insert 43 of FIG. 12, with the sheet 40 separated along score line 41 to form two panels 44, 45. The positioning of the plastic film 42 in this embodiment is similar to that described above with respect to the first embodiment.

Figure 15:
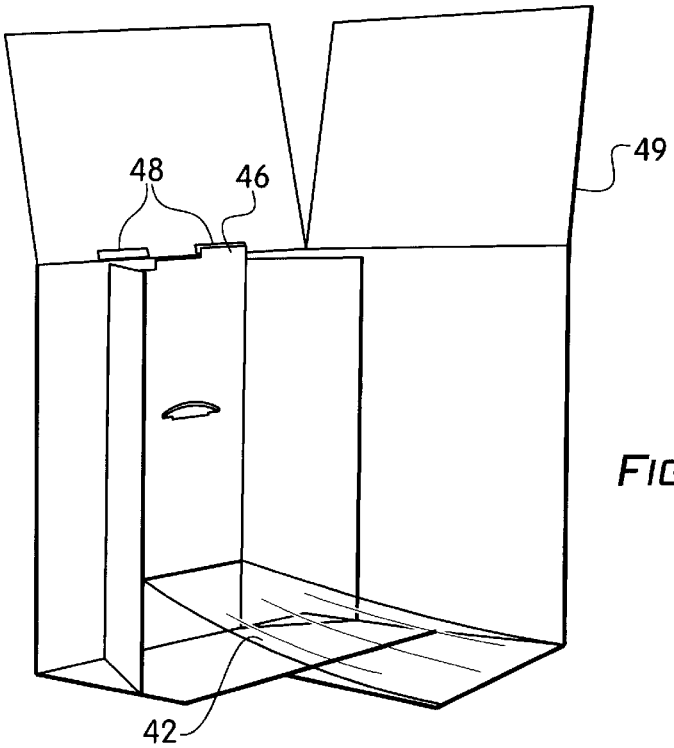
FIG. 15 shows a cutaway view of a box with the insert of FIG. 12 positioned within the box, showing one panel of the insert.
Figure 16:
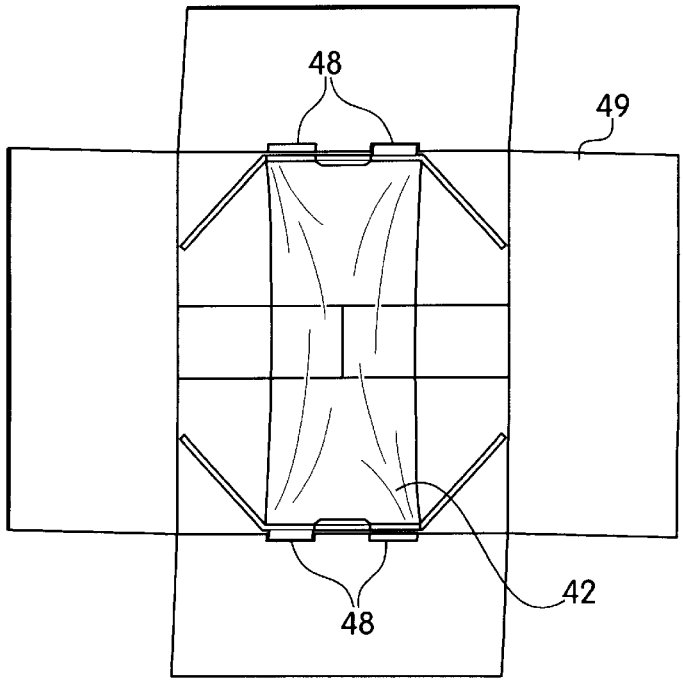
FIG. 16 shows a top view of the box of FIG. 15 with the insert in place.
Figure 17:
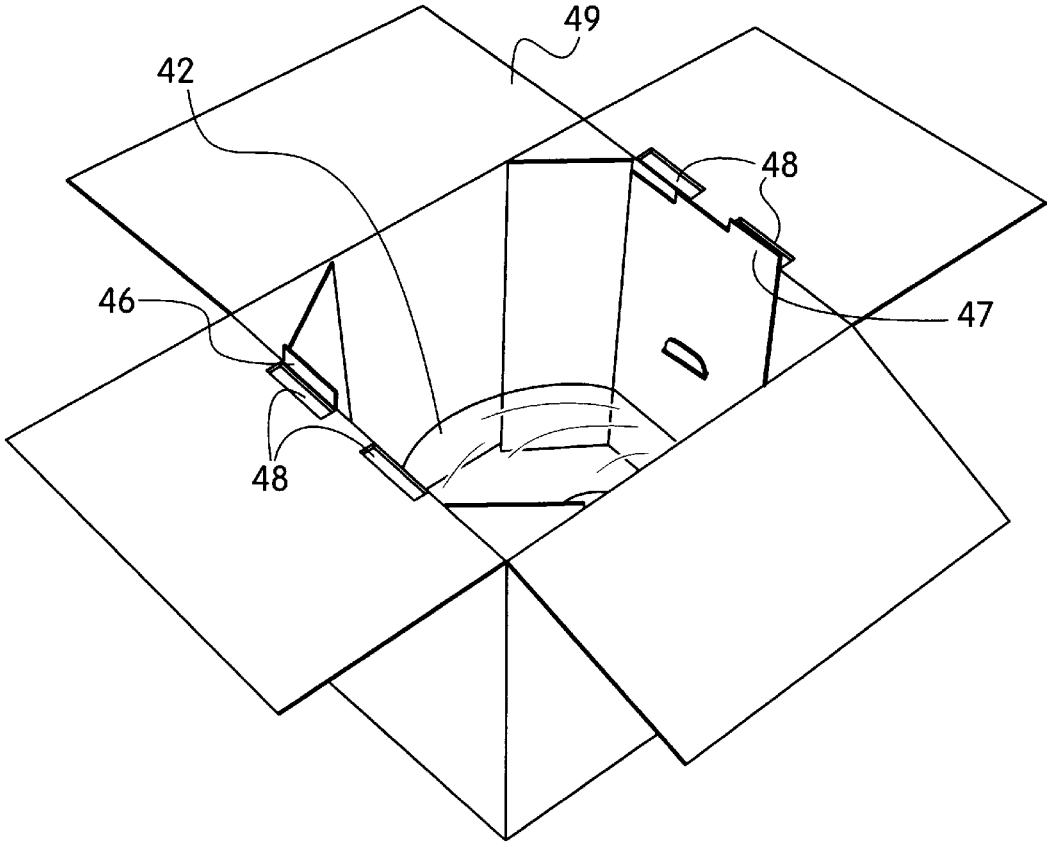
FIG. 17 shows a perspective view of the box of FIG. 15 with the insert in place, showing the inside of the box.

The score line 41 is configured such that the panels 44, 45 have projections 46, 47, respectively, when they are separated from each other. As shown in FIGS. 15 through 17, the box 49 has slots 48 for receiving and retaining the projections 46, 47 when the lid of the box 49 is closed. In this manner, the lid of the box retains the insert 43 in place.

Figure 18:
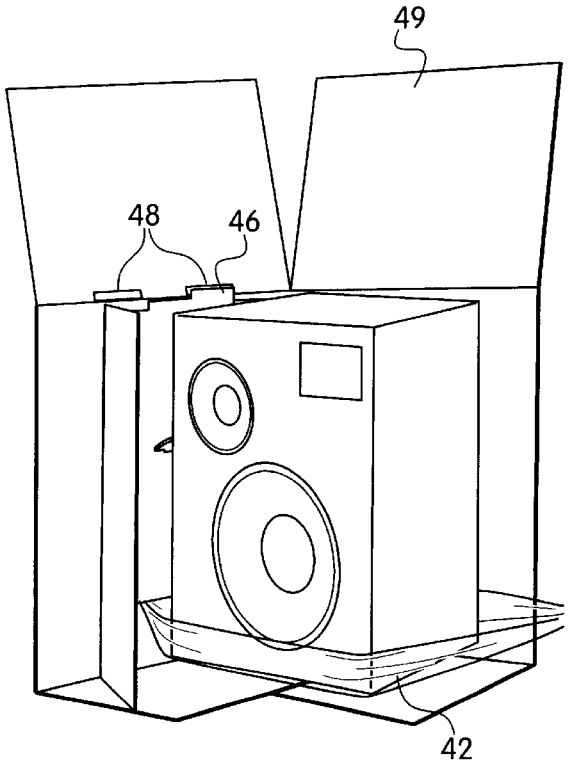
FIG. 18 shows a view similar to FIG. 15, with an item being supported by the plastic film.
Figure 19:
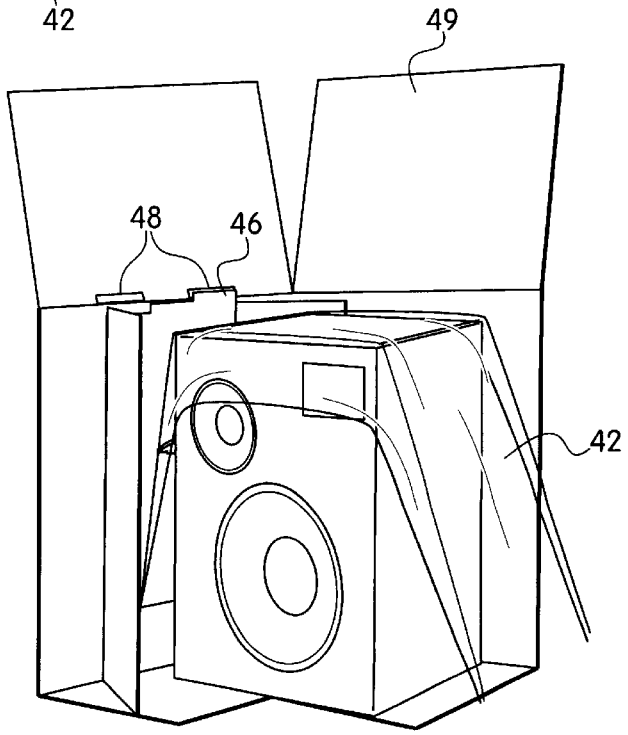
FIG. 19 shows a view similar to FIG. 15, with an item being held down by the plastic film.

FIGS. 18 and 19 show this second illustrated embodiment in use to secure an item, by supporting, suspending, and/or holding down the item. This operation is similar to that described above with respect to the first illustrated embodiment.

Figure 20:
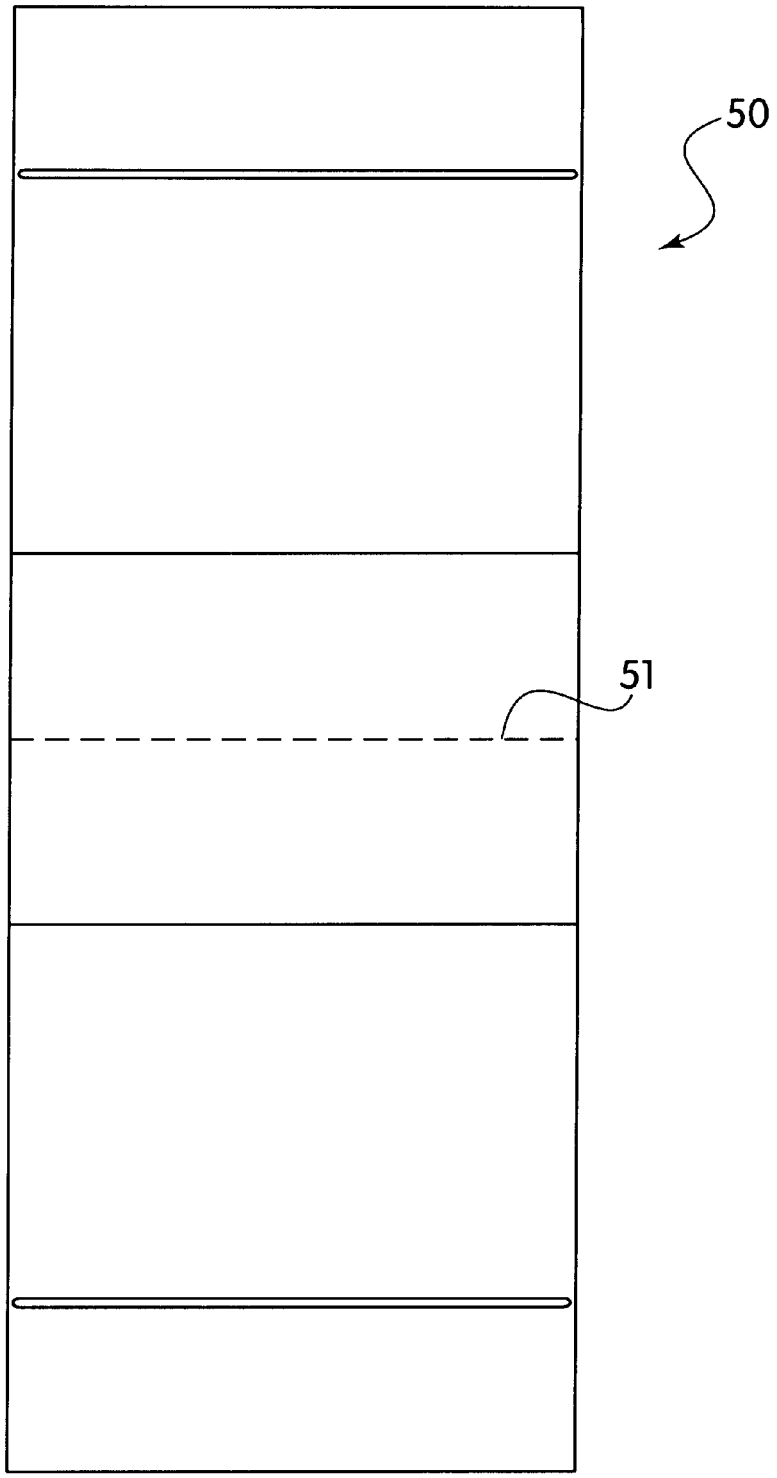
FIG. 20 shows a sheet portion of an insert in accordance with a third embodiment of the invention.
Figure 21:
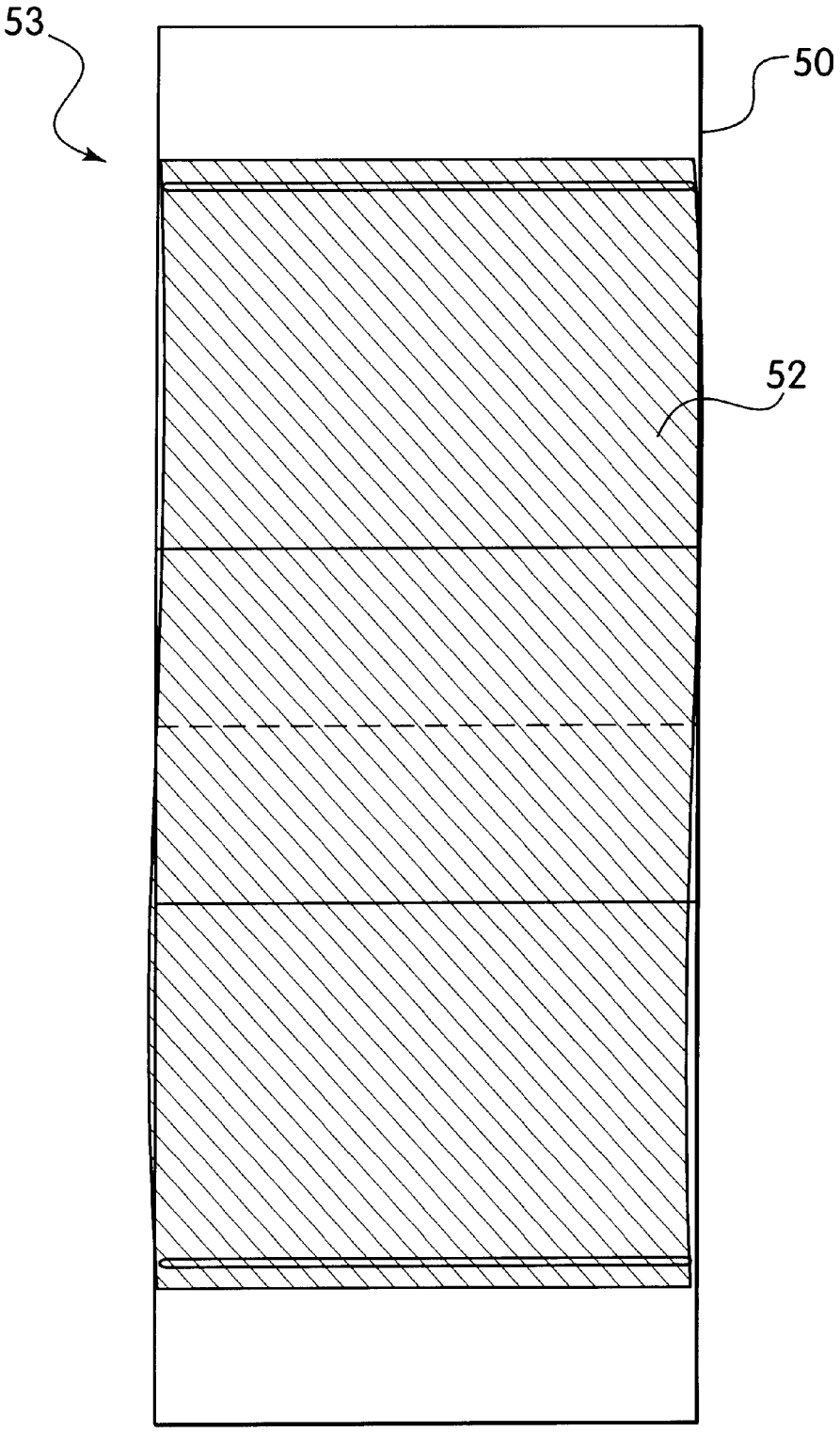
FIG. 21 shows the sheet of FIG. 20, with plastic film glued to the sheet, forming the completed insert.

FIG. 20 shows a sheet 50 for an insert in accordance with a third embodiment of the invention. FIG. 21 shows the sheet 50 with plastic film 52 glued to the sheet 50, forming the completed insert 53.

Figure 22:
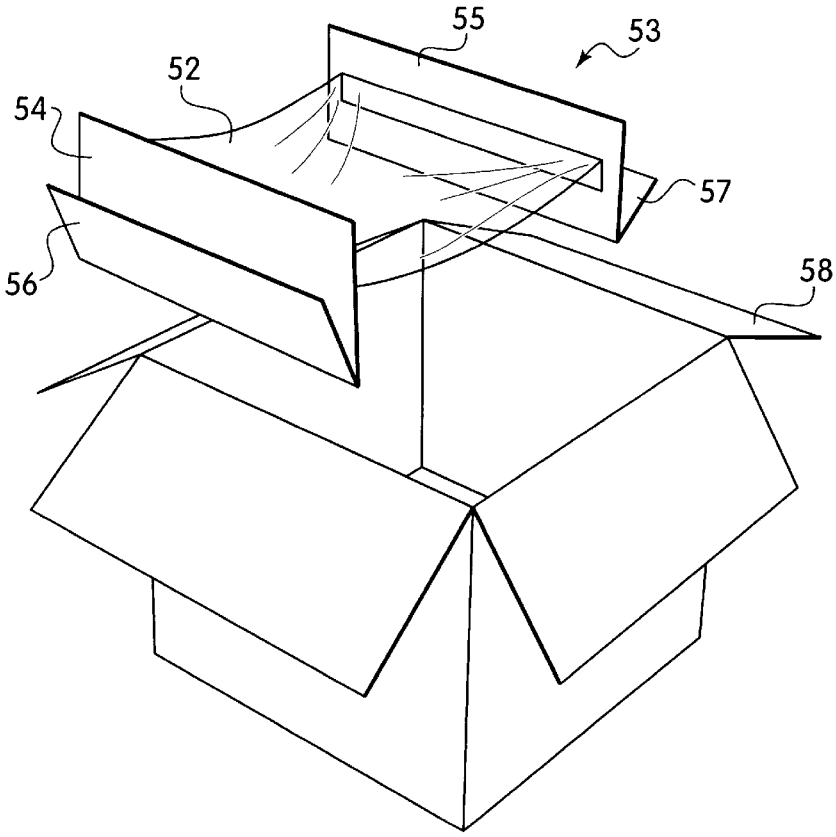
FIG. 22 shows the insert of FIG. 20, with the sheet portion separated to form two panels, being inserted into a box.

FIG. 22 shows the insert 53 of FIG. 20, with the sheet 50 separated along score line 51 to form two panels 54, 55. The insert 53 is shown being inserted into a box 58.

Figure 23:
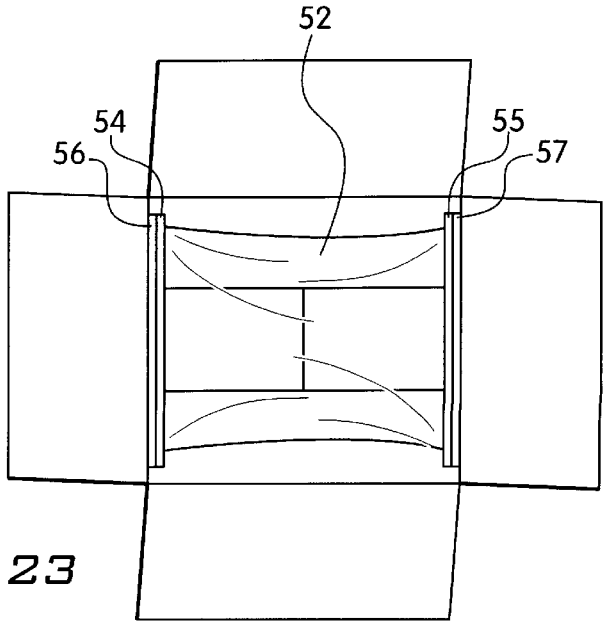
FIG. 23 shows a top view of the box of FIG. 22 with the insert in place.
Figure 24:
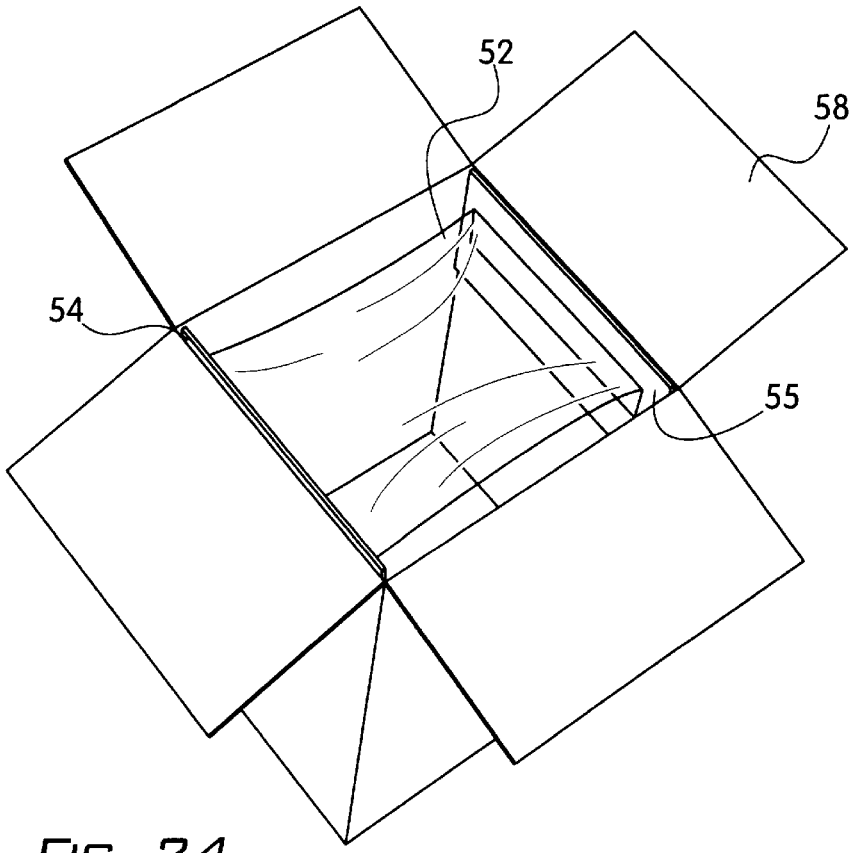
FIG. 24 shows a perspective view of the box of FIG. 22 with the insert in place, showing the inside of the box.
Figure 25:
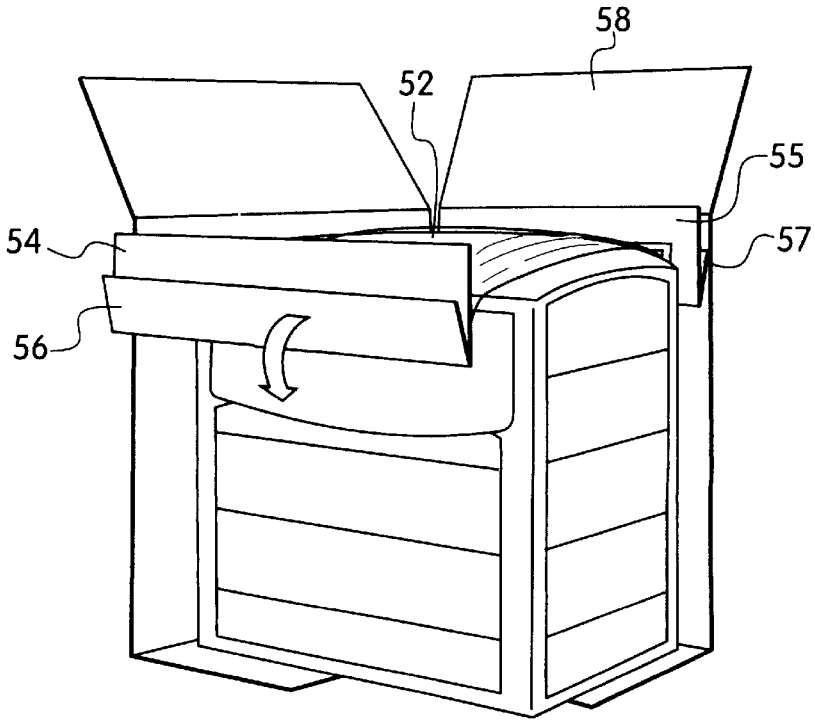
FIG. 25 shows a cutaway view of the box of FIG. 22 with the insert in place, with an item being held down by the plastic film.

In this embodiment, the panels 54, 55 have flaps 56, 57, respectively, which may be folded away from the central portion of the insert as shown. When placed in the box 58, the flaps 56, 57 are positioned between the respective side of the box and the main portion of the panel 54, 55, as shown in FIGS. 23 through 25. These flaps 56, 57 help maintain the position of the panels 54, 55, providing additional protection in the form of cushion and support to the respective box sides. As shown in FIG. 25, the plastic film in this embodiment may be used to support, suspend, and/or hold down an item in a manner similar to that described above with respect to other embodiments.

Figure 25B:
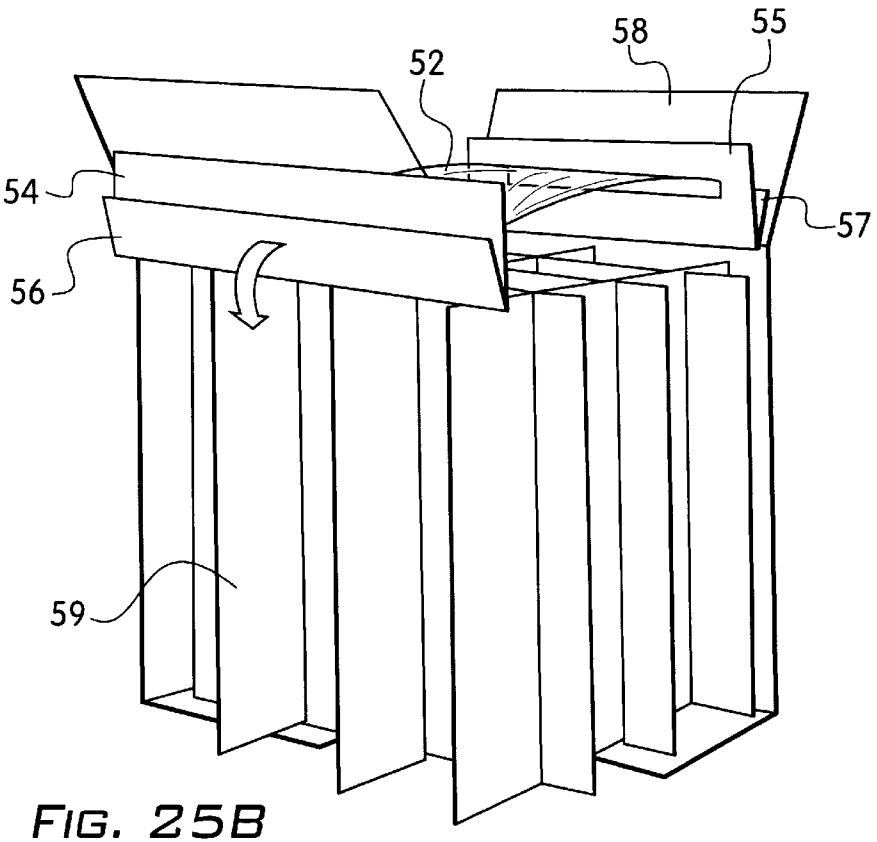
FIG. 25B shows the box of FIG. 25A, in a view similar to FIG. 25.
Figure 25A:
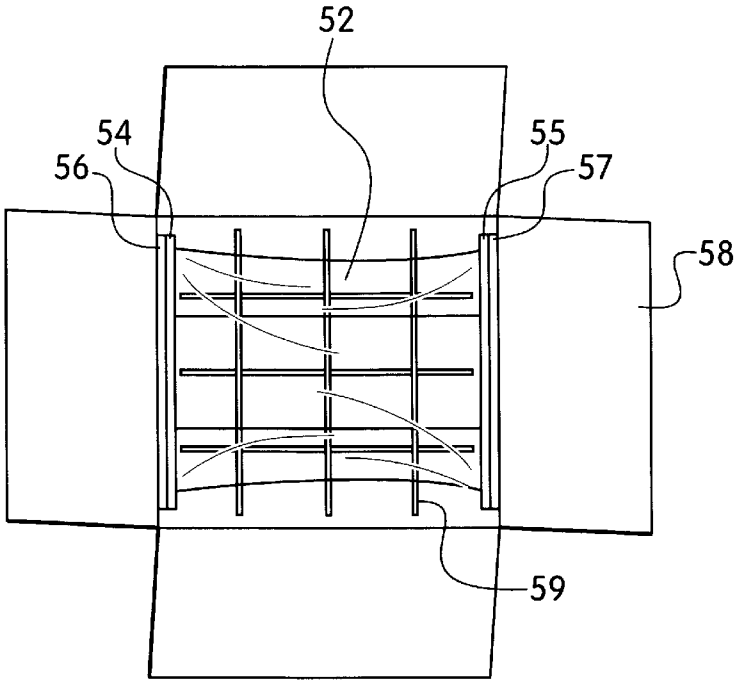
FIG. 25A shows a view similar to FIG. 23, with the box having partitions.

As shown in FIGS. 25A and 25B, the box 58 may have dividers or partitions 59 within it. The resilient element 52 may serve to secure the partitions 59 as well as the individual items within the partitions. Of course, partitions may be used with other embodiments in accordance with the invention.

Figure 26:
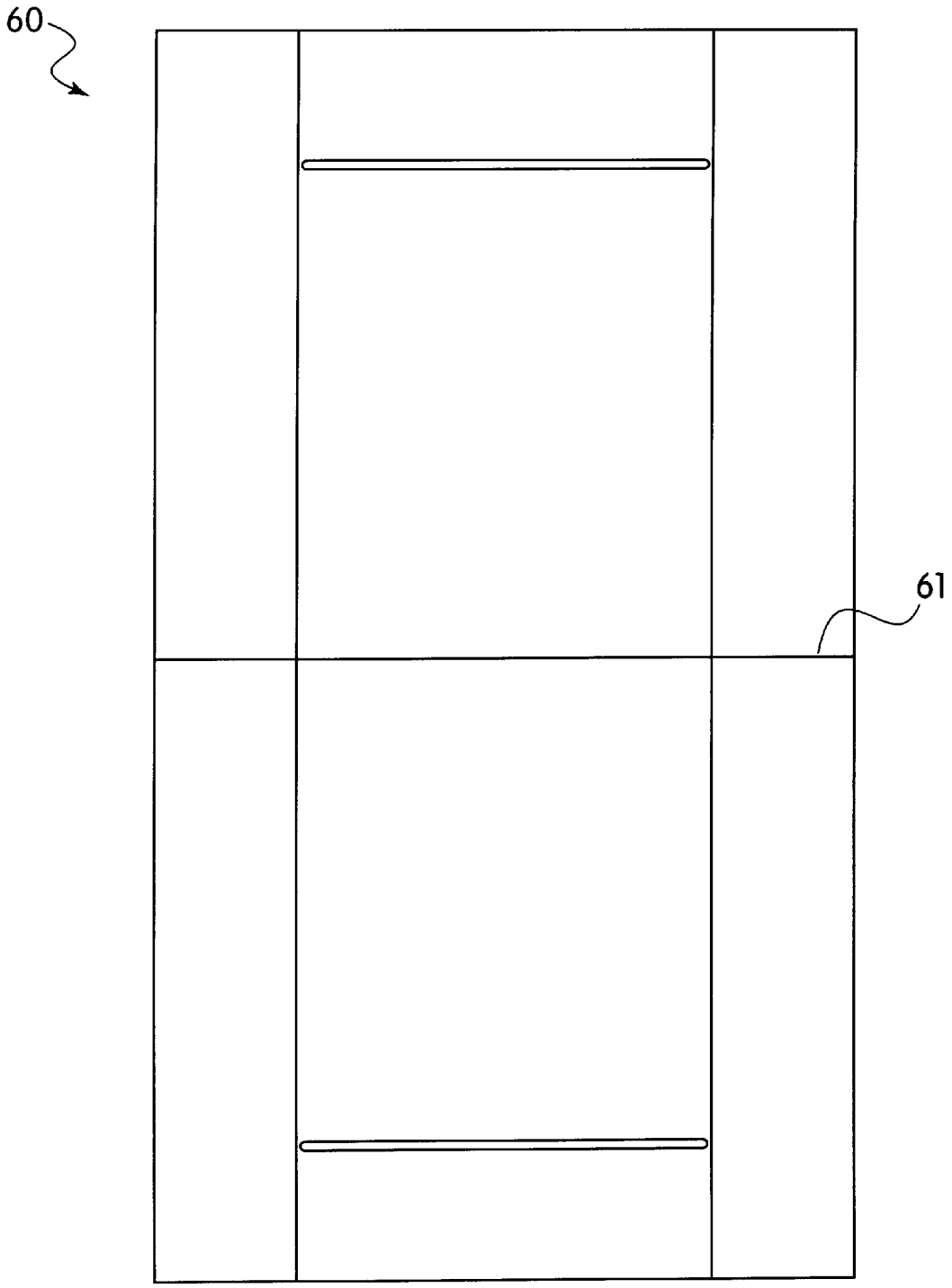
FIG. 26 shows a sheet portion of an insert in accordance with a fourth embodiment of the invention.
Figure 27:
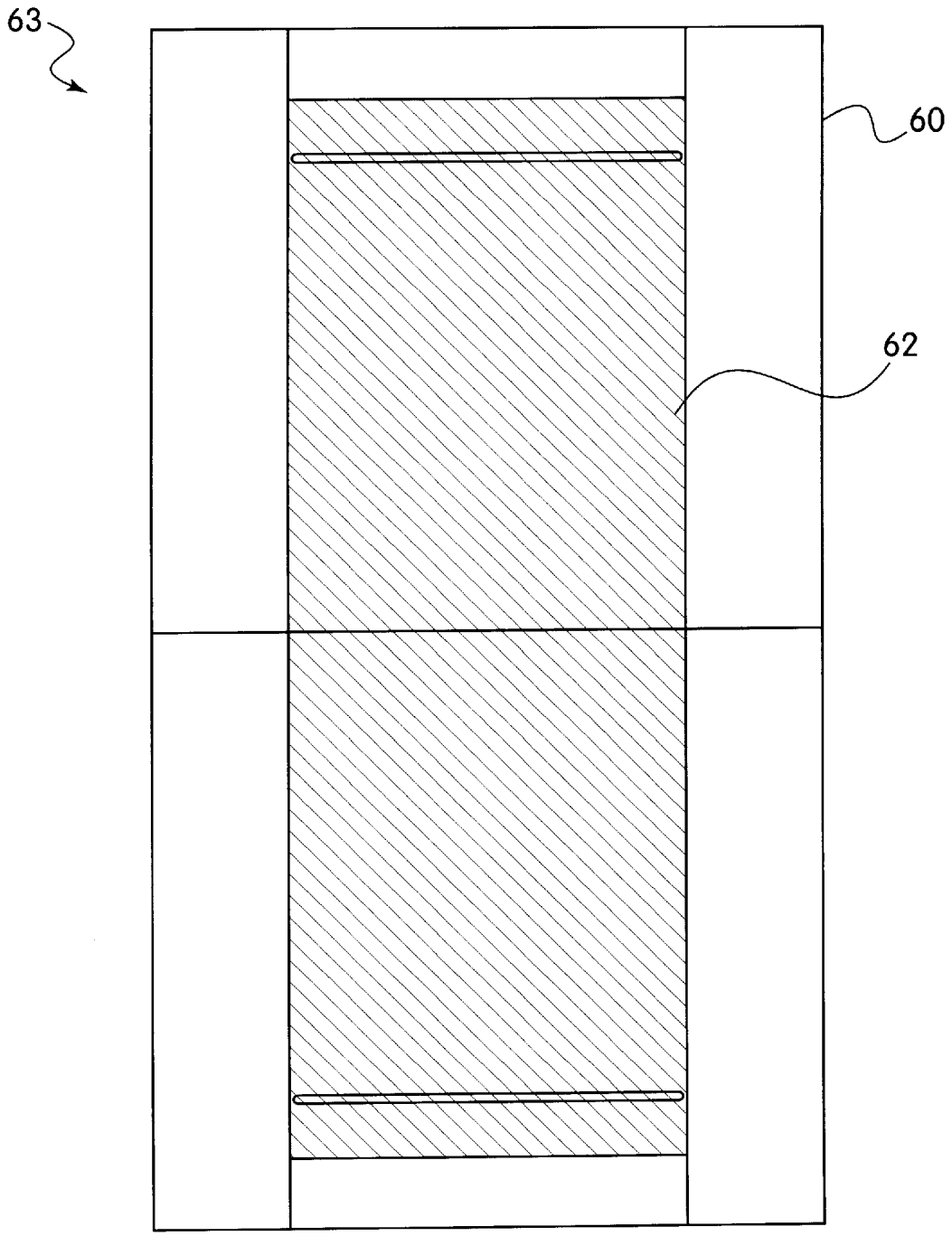
FIG. 27 shows the sheet of FIG. 26, with plastic film glued to the sheet, forming the completed insert.

FIG. 26 shows a sheet 60 for an insert in accordance with a fourth embodiment of the invention. FIG. 27 shows the sheet 60 of FIG. 26, with plastic film 62 glued to the sheet 60, forming the completed insert 63.

Figure 28:
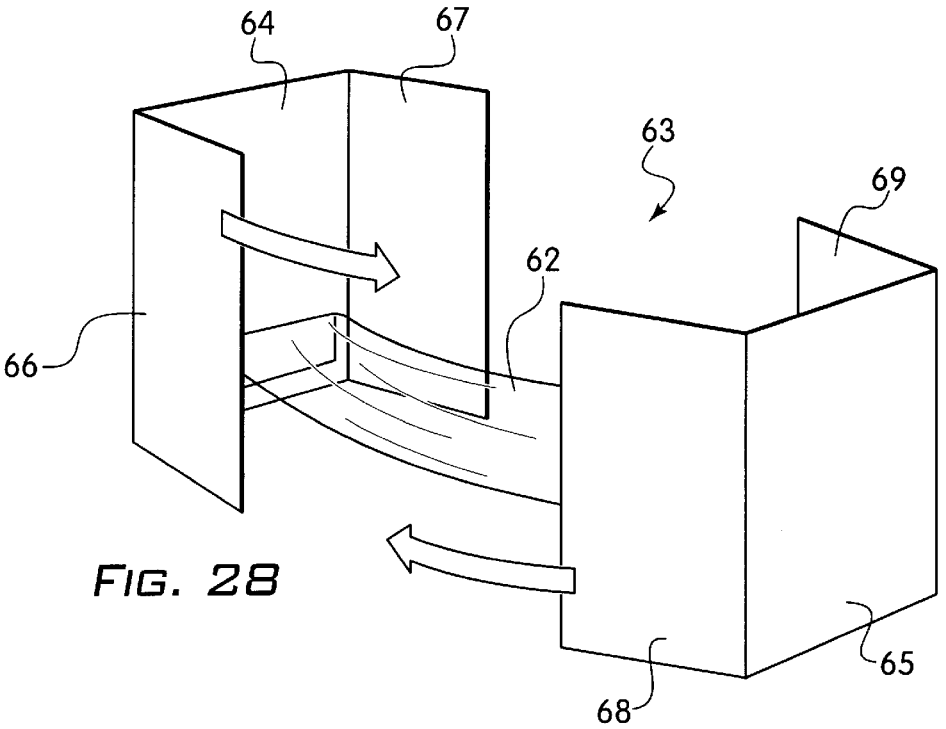
FIG. 28 shows the insert of FIG. 27, with the sheet portion separated to form two panels.
Figure 29:
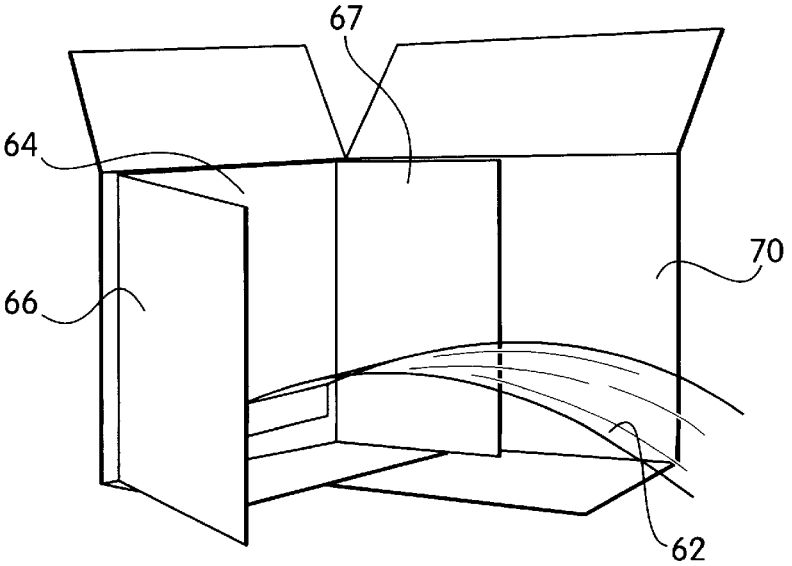
FIG. 29 shows a cutaway view of a box with the insert of FIG. 27 positioned within the box, showing one panel of the insert.
Figure 30:
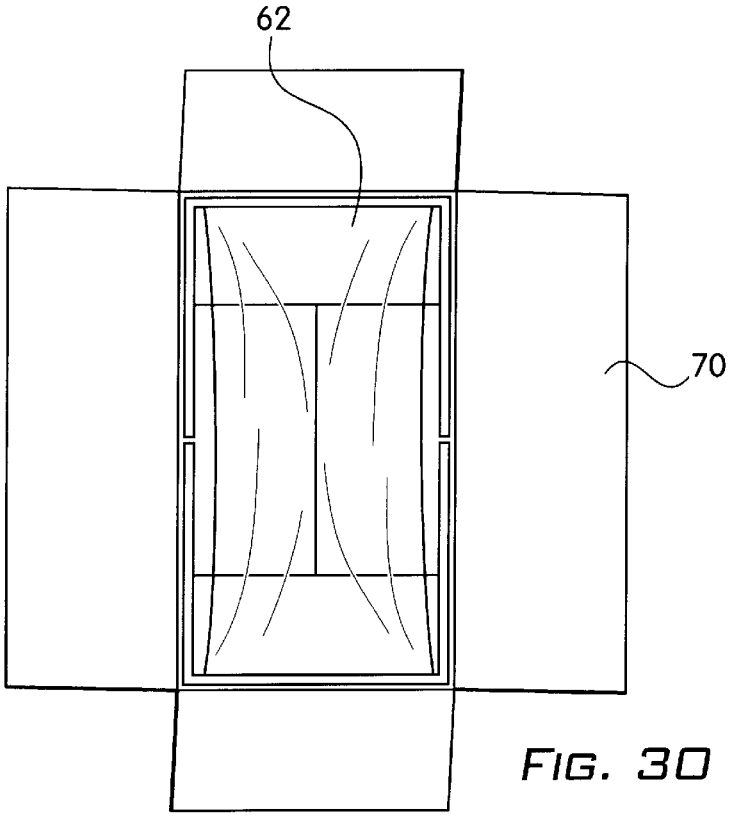
FIG. 30 shows a top view of the box of FIG. 27 with the insert in place.
Figure 31:
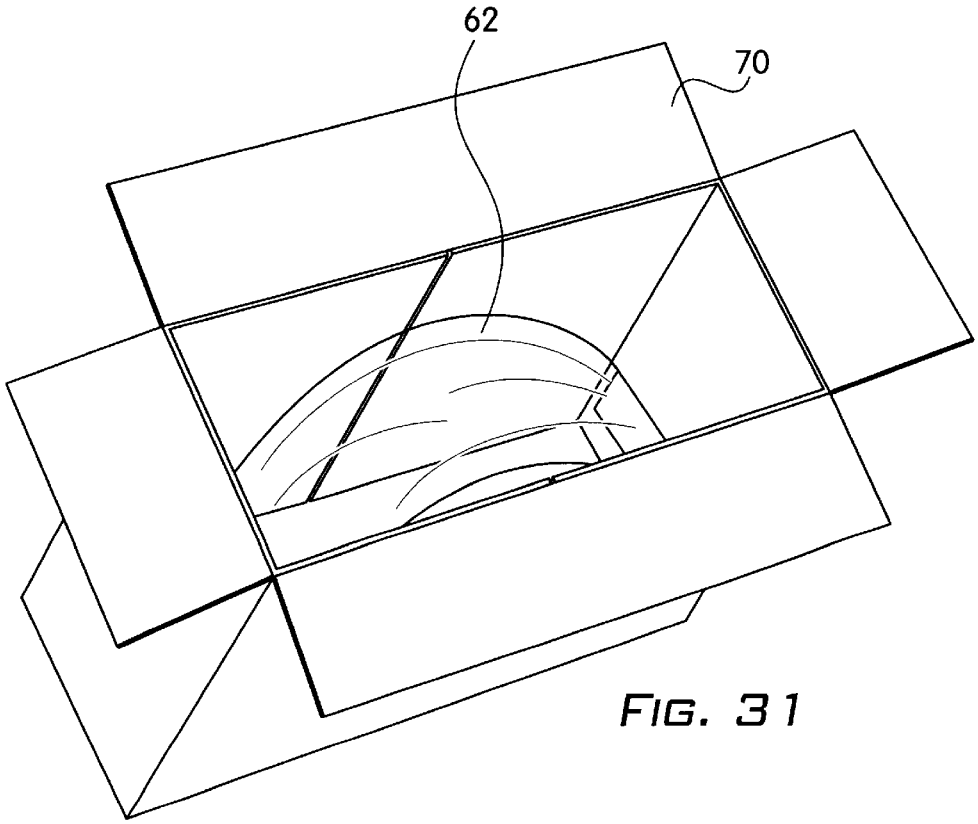
FIG. 31 shows a perspective view of the box of FIG. 27 with the insert in place, showing the inside of the box.

FIG. 28 shows the insert 63 of FIG. 27, with the sheet 60 separated along score line 61 to form two panels 64, 65. In this embodiment, each of the panels 64, 65 comprises two side panels 66, 67 and 68, 69, respectively. To fit the panels 64, 65 against the appropriate sides of the box, the side panels 66, 67 and 68, 69 are folded, as shown in FIGS. 28 through 31. The plastic film 62 in this embodiment serves to support, suspend, and/or hold down an item in a manner similar to that described above with respect to other embodiments.

Figure 32:
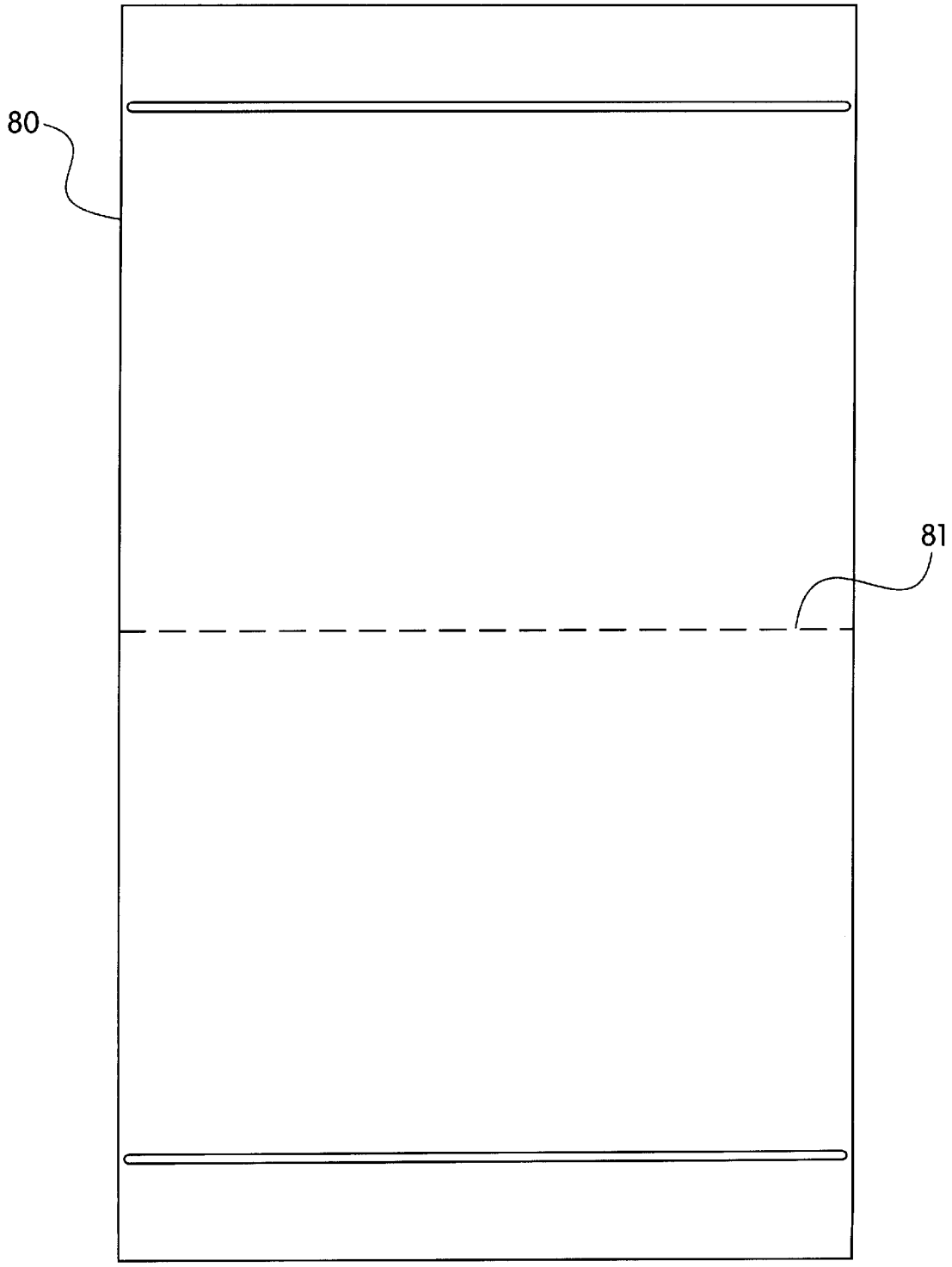
FIG. 32 shows a sheet portion of an insert in accordance with a fifth embodiment of the invention.
Figure 33:
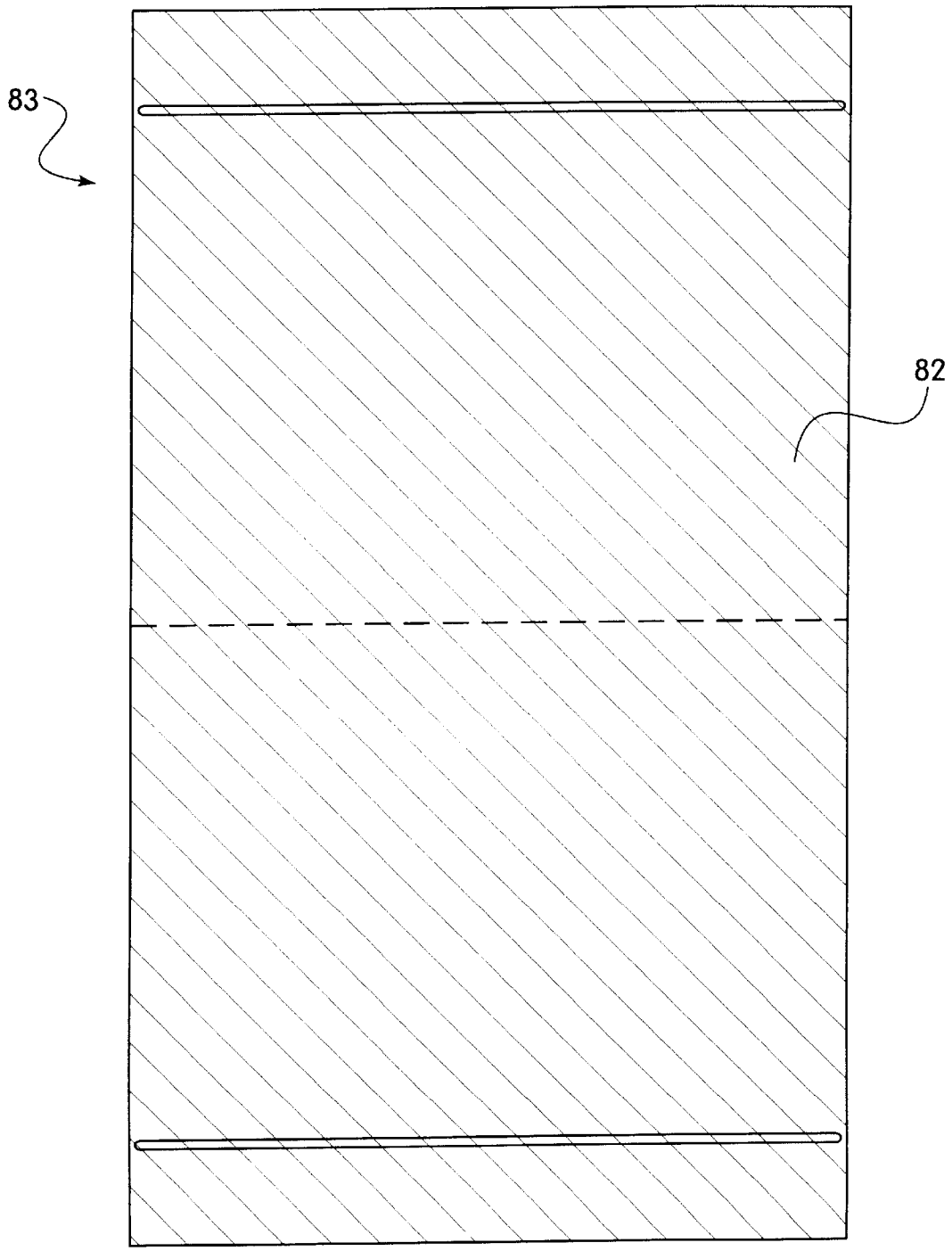
FIG. 33 shows the sheet of FIG. 32, with plastic film glued to the sheet, forming the completed insert.
Figure 34:
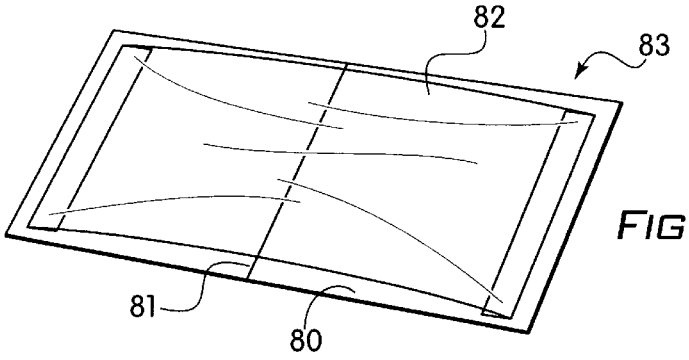
FIG. 34 shows a perspective view of the insert of FIG. 33.

FIG. 32 shows a sheet 80 for an insert in accordance with a fifth embodiment of the invention. FIG. 33 shows the sheet 80 of FIG. 32, with plastic film 82 glued to the sheet 80, forming the completed insert 83. The completed insert is also shown in FIG. 34.

Figure 35:
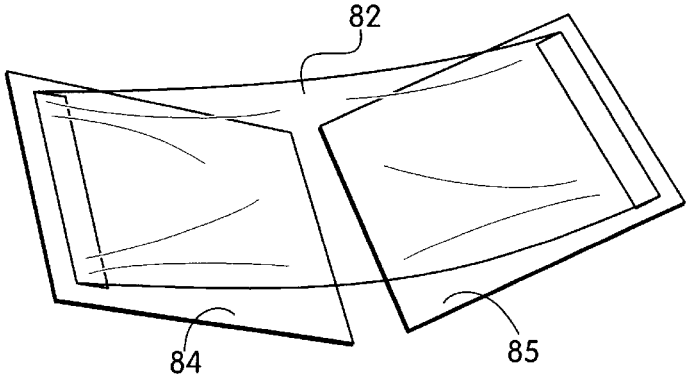
FIG. 35 shows a perspective view of the insert of FIG. 33, with the sheet portion separated to form two panels.
Figure 38:
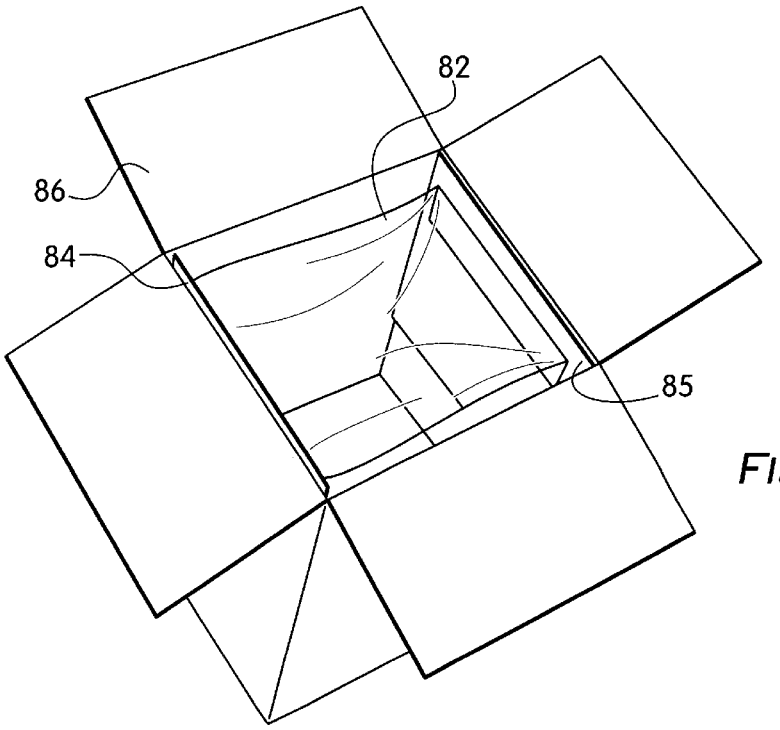
FIG. 38 shows a perspective view of the box of FIG. 36 with the insert in place, showing the inside of the box.
Figure 36:
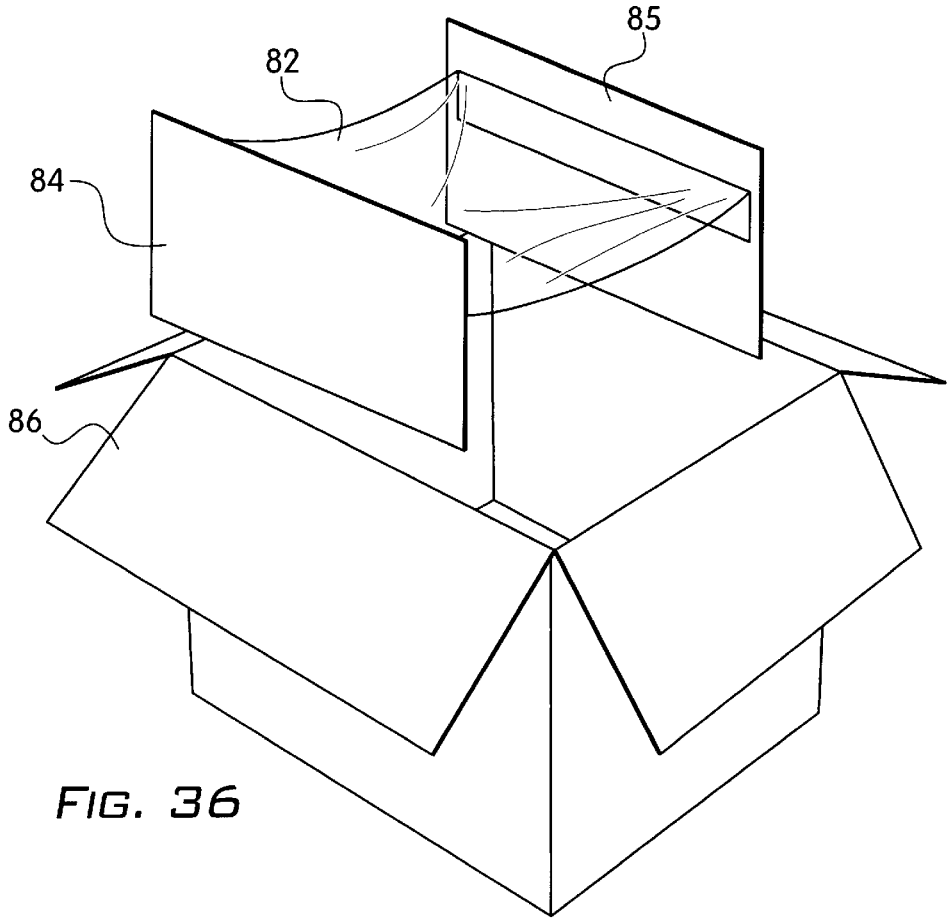
FIG. 36 shows the insert of FIG. 33 being inserted into a box.
Figure 37:
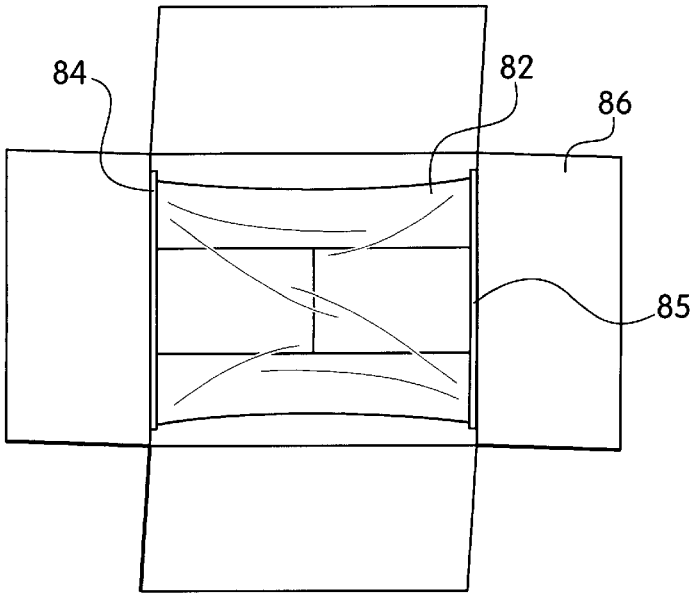
FIG. 37 shows a top view of the box of FIG. 36 with the insert in place.
Figure 39:
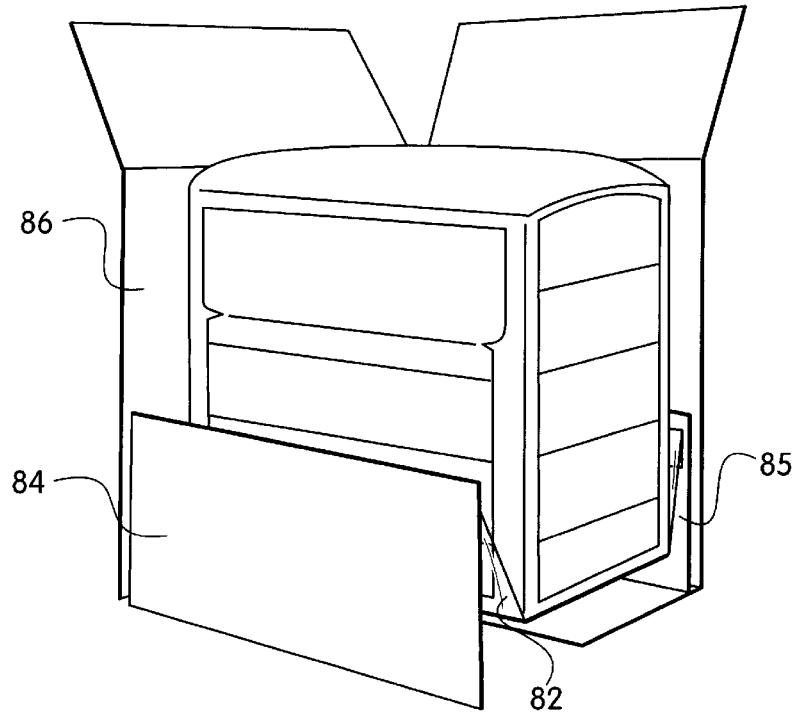
FIG. 39 shows a cutaway view of the box of FIG. 22 with the insert in place, with an item being supported by the plastic film.
Figure 40:
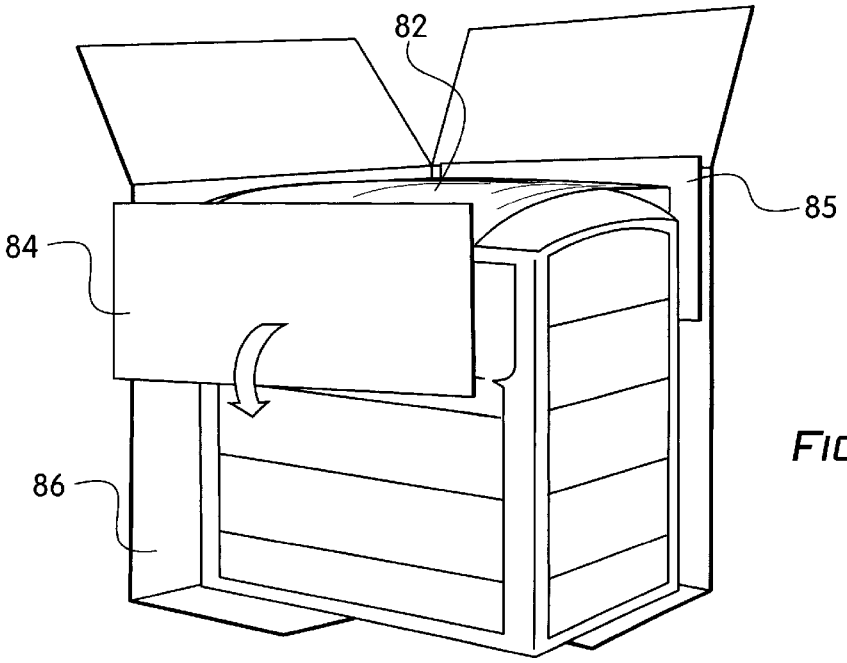
FIG. 40 shows a view similar to that of FIG. 39 with the insert in place, with an item being held down by the plastic film.

FIG. 35 shows the insert 83 with the sheet 80 separated along score line 81 to form two panels 84, 85. As shown in FIGS. 36 through 40, the panels 84, 85 are positioned on the inside of opposite side panels of a box 86, with the plastic film 82 extending between the panels. The insert 83 serves to support, suspend, and/or hold down an item in a manner similar to that described above.

Figure 41:
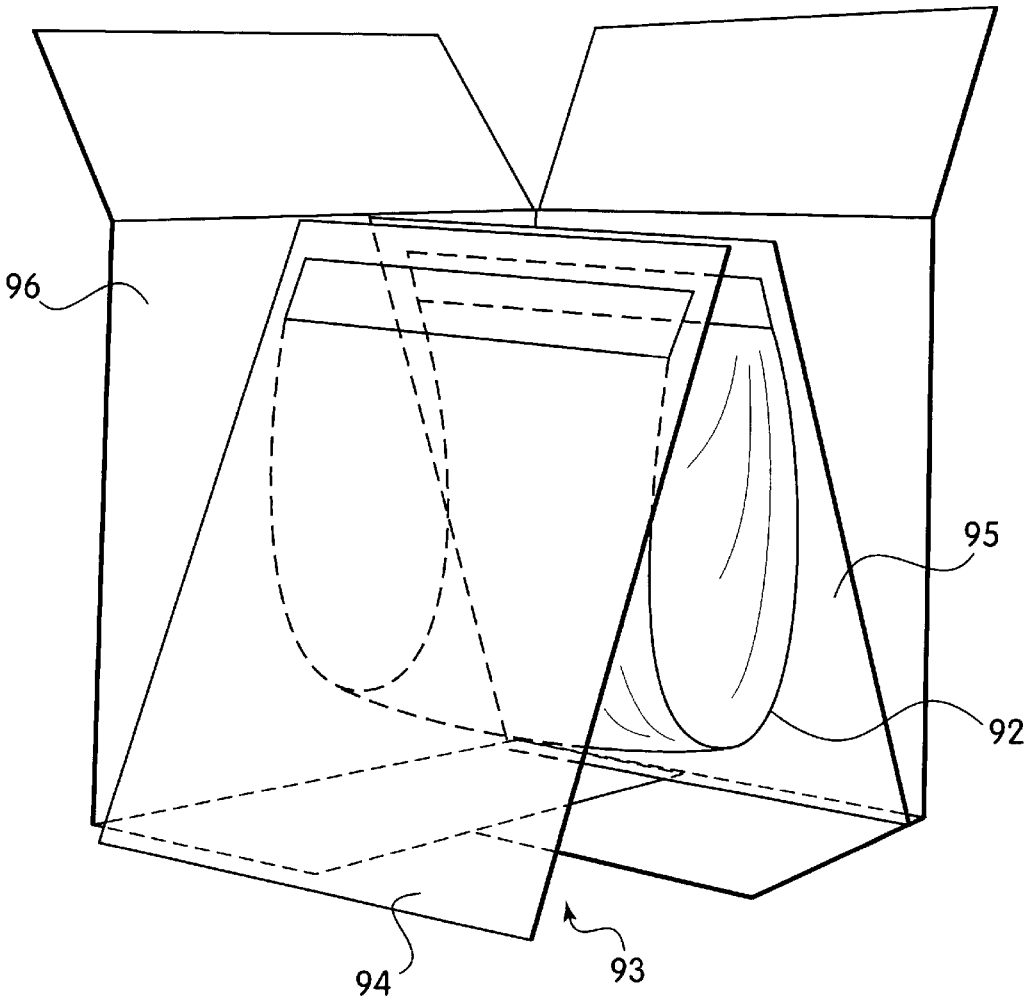
FIG. 41 shows an alternative embodiment of an insert similar to that of FIG. 33 positioned within a box.

FIG. 41 shows an alternative insert 93 similar to the insert 83. In this embodiment, the panels 84, 85 extend the full height of the box 36, and may be themselves be taller than the box 6 so that they are angled when in use. The operation of the insert is similar to that described above. This configuration is especially adapted, for example, to the support and suspension of items having a larger base narrowing to a smaller top, as in tapered, tiered, or conical configurations.

Figure 42:
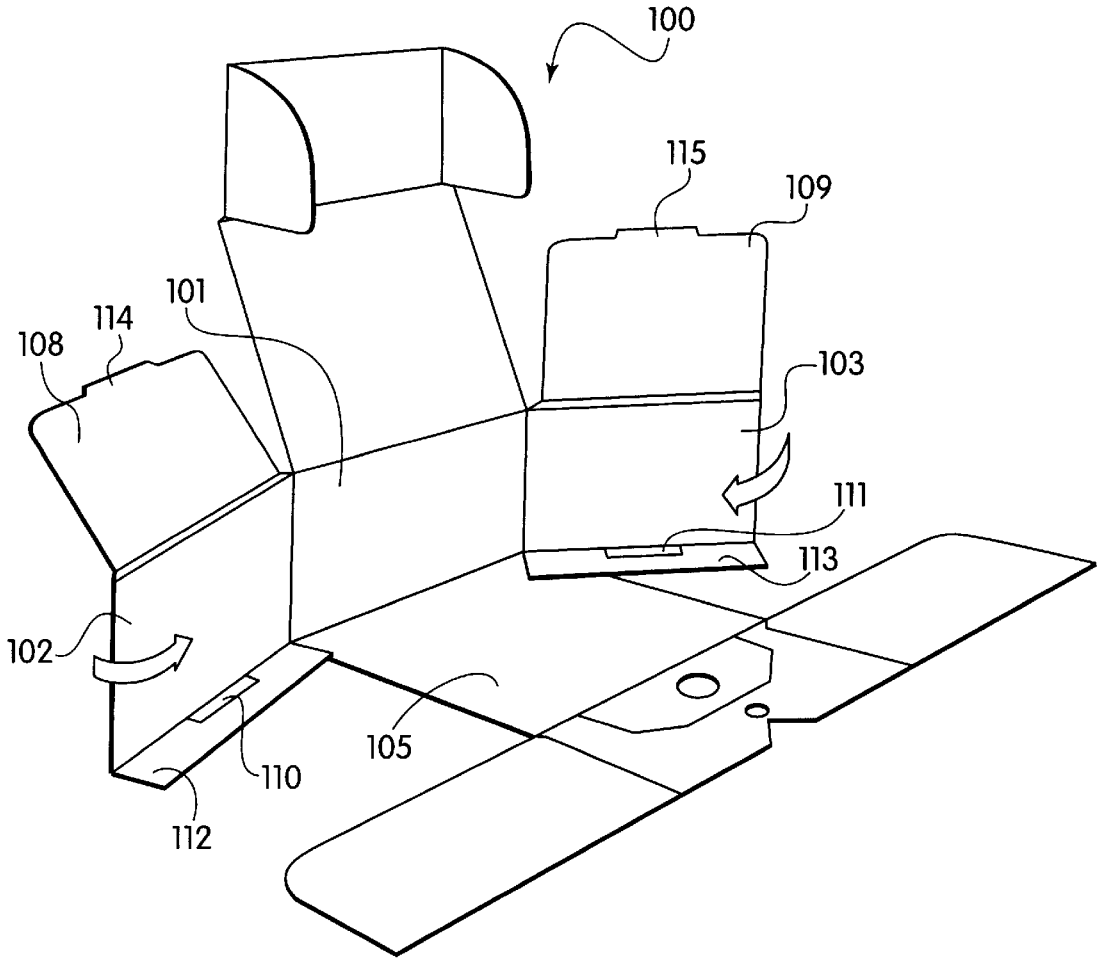
FIG. 42 shows an initial stage of assembly of a box of an alternative embodiment of the invention.
Figure 43:
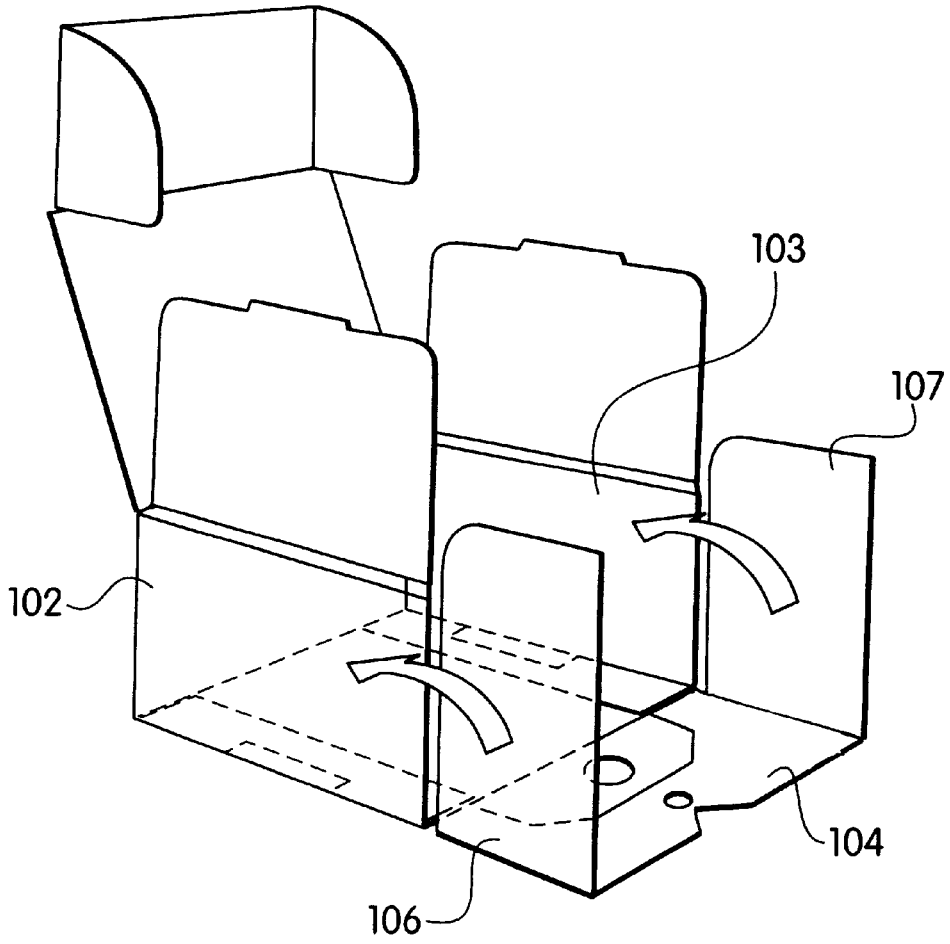
FIG. 43 shows a further state of assembly of the box as shown in FIG. 42.
Figure 44:
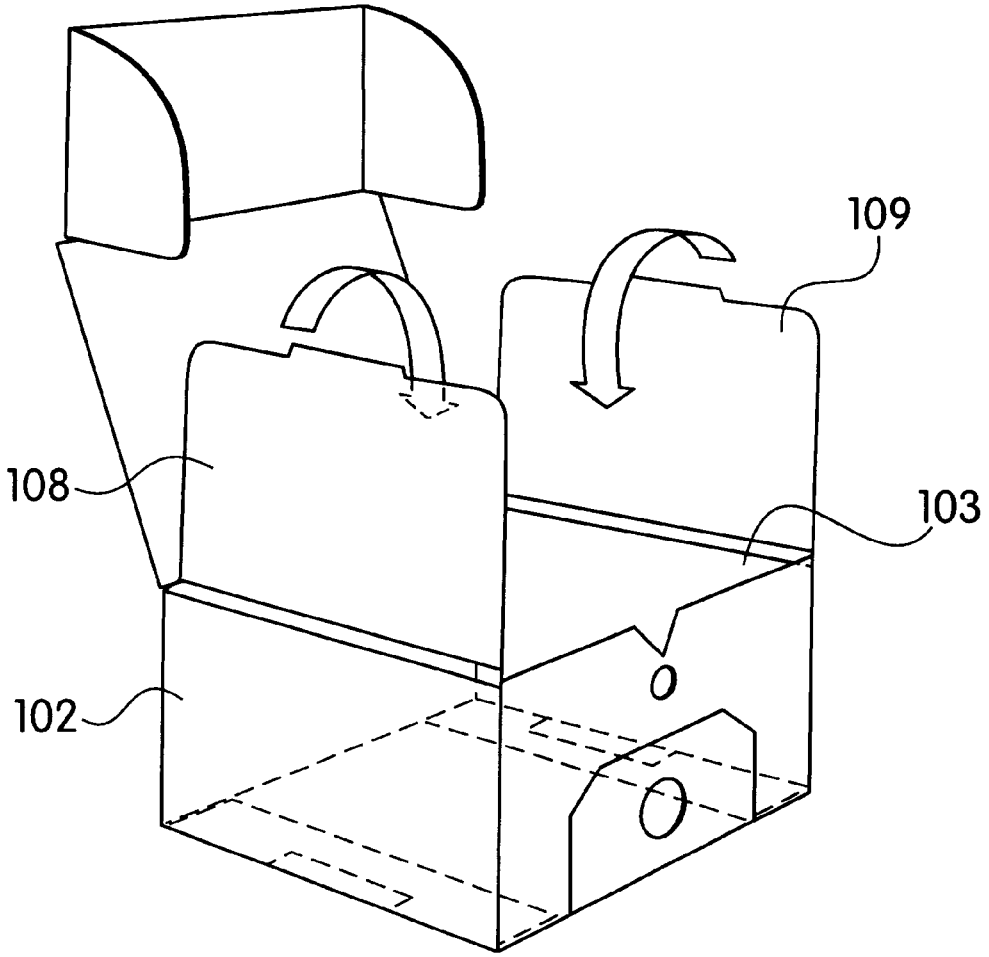
FIG. 44 shows a further stage of assembly of the box as shown in FIG. 42.
Figure 46:
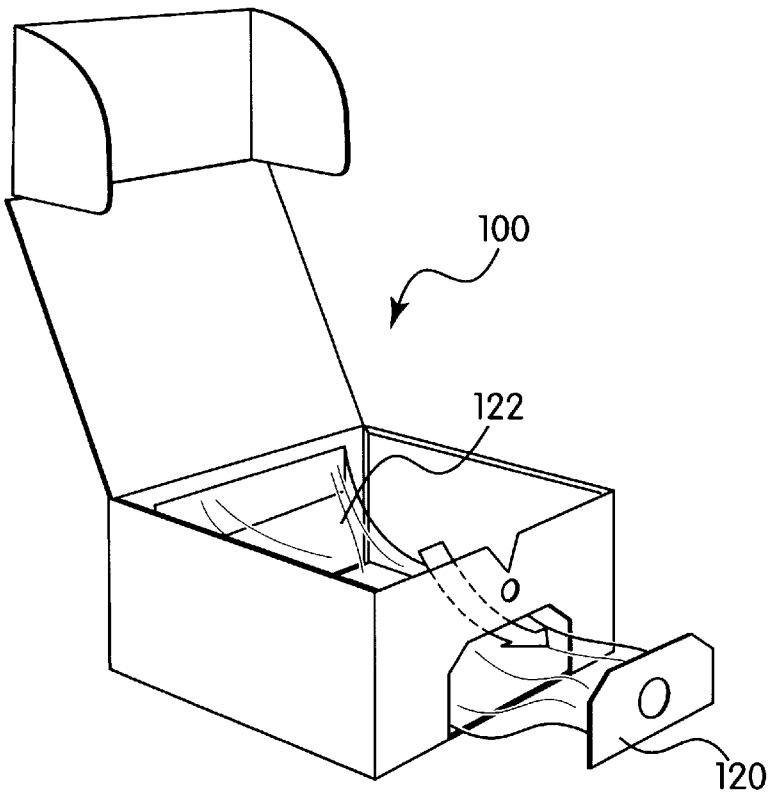
FIG. 46 shows a view similar to FIG. 45, with the resilient element being exposed by withdrawal of a handle.
Figure 45:
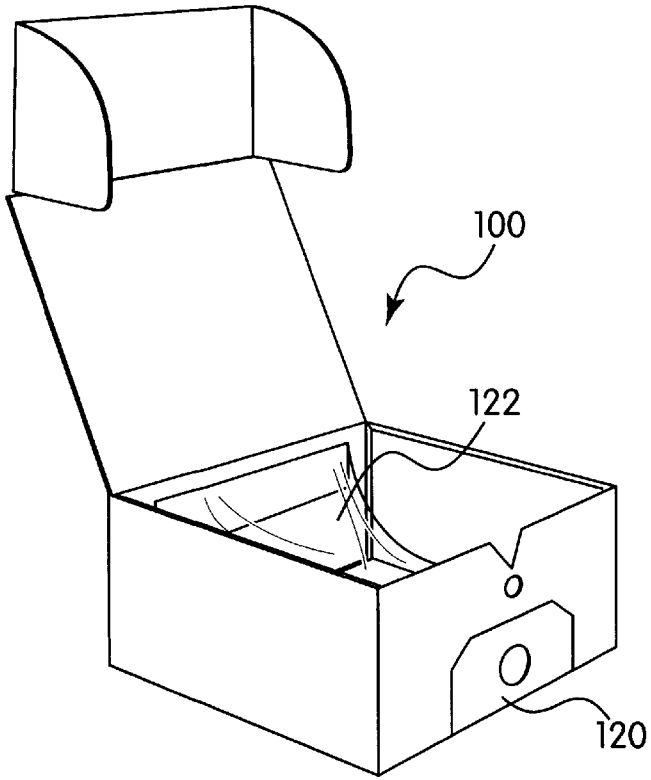
FIG. 45 shows the assembled box of FIGS. 42 through 44, showing the resilient element.

FIG. 42 shows an initial stage of assembly of a box 100 for an alternative embodiment of the invention. Side panels 101, 102 and 103 are folded with respect to bottom panel 105 to form three side of the box 100. Subsequently, as shown in FIG. 43, side panel 104 is folded with respect to bottom panel 105, and side flaps 106, 107 are inserted within side panels 102, 103, respectively. Then, as shown in FIG. 44, side flaps 108, 109 are folded inside of side panels 102, 103. Tabs 114, 115 (labeled in FIG. 42) are inserted into slots 110, 111 in flaps 112, 113, to secure the side panels 108, 109 in place.

As shown in FIGS. 45 through 50, the box has a resilient element 122 within it, the resilient element 122 being in the form of a tube. A handle 120, which may be formed by score liens in side panel 104, is secured to one end of the resilient element 122. The other end of the resilient element 122 is attached to the inside of the box 100, for example by a glue strip 125 on the inside of the side panel 101.

Figure 48:
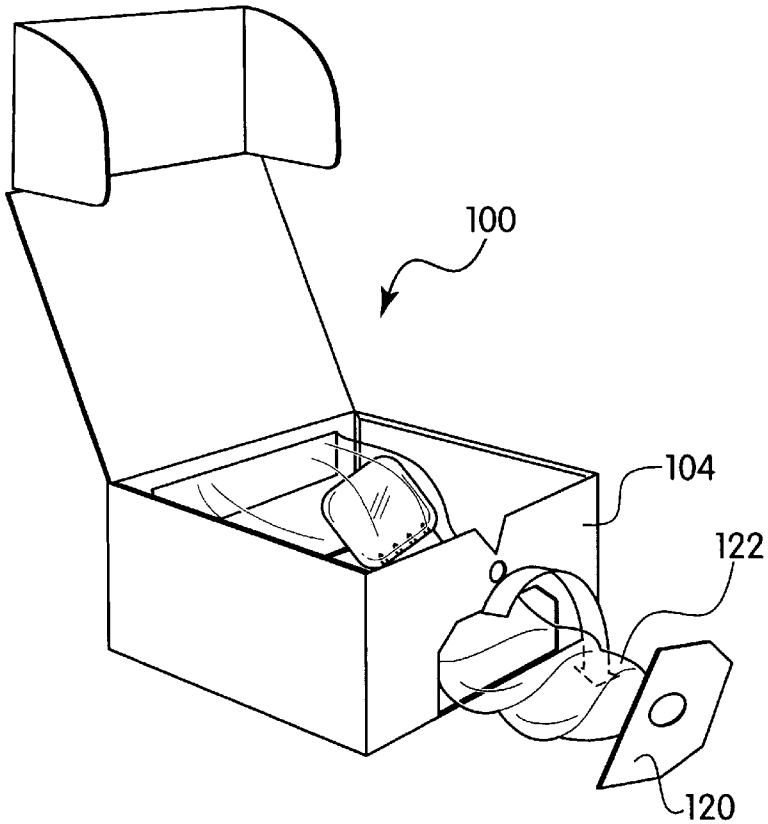
FIG. 48 shows a view similar to FIG. 47, with the resilient element being twisted to secure the item.
Figure 47:
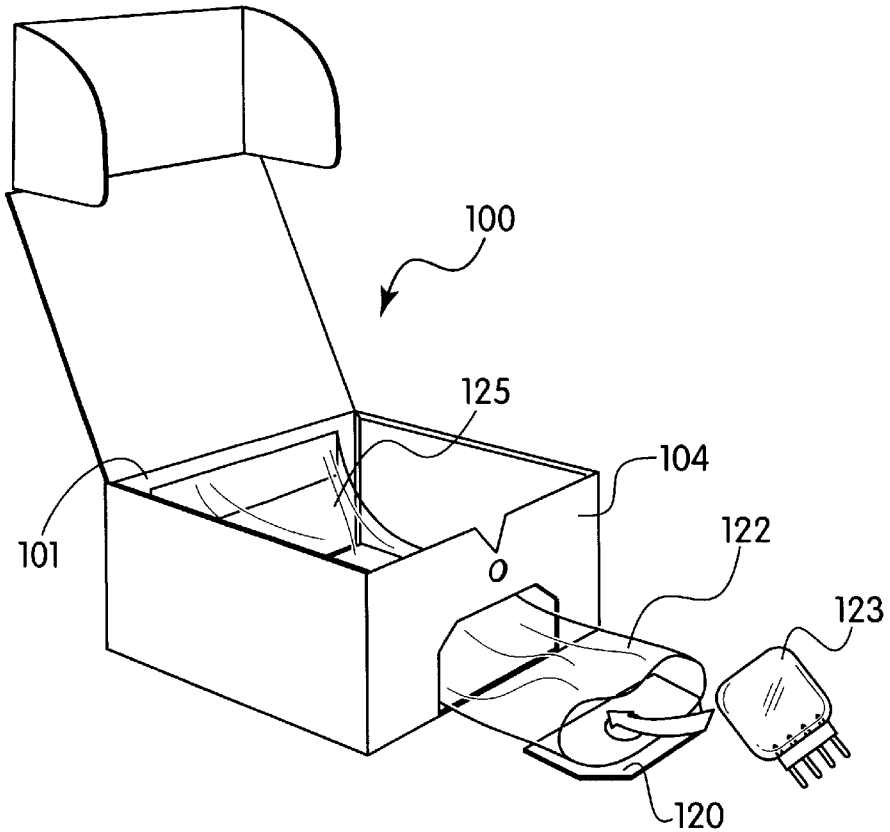
FIG. 47 shows a view similar to FIG. 46, with an item being placed in the resilient element.

Withdrawing the handle 120 exposes an open end of the resilient element 122. An item 123 to be secured may be placed in the opening in the resilient element 122. As shown in FIG. 48, the handle 120 may be used to twist the resilient element 122 to tighten it around the item 123.

Figure 50:
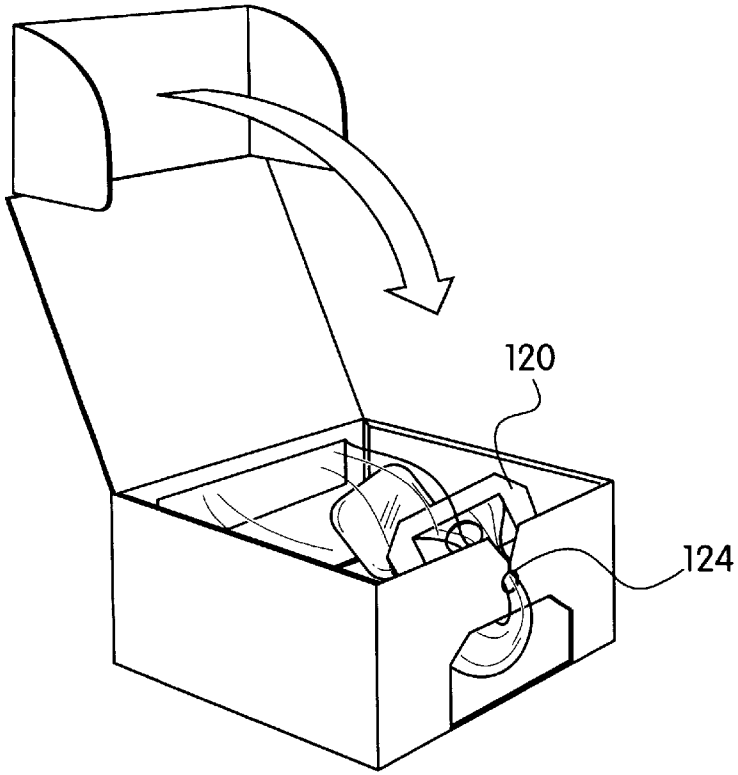
FIG. 50 shows a view similar to FIG. 49, showing the closing of the box lid.
Figure 49:
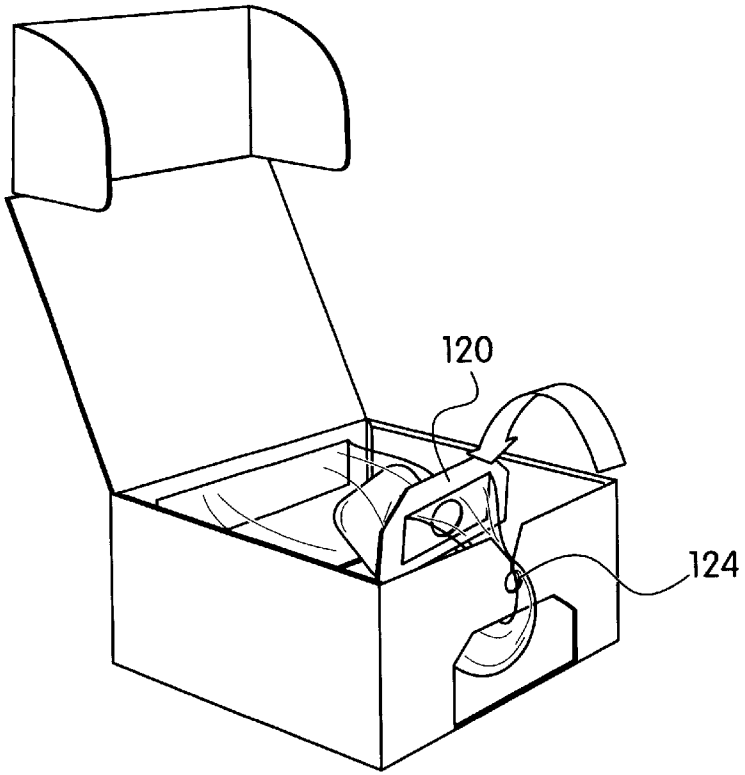
FIG. 49 shows a view similar to FIG. 48, with the resilient element being cinched.

Once the item is in place, the resilient element 122 may be cinched by a cinching element, for example, a slot 124, as illustrated in FIGS. 49 and 50. Alternatively, a clip or other suitable cinching mechanism may be used. As will be appreciated by persons or ordinary skill in the art, as in previous embodiments, this embodiment suspends the item within the box to reduce or eliminate the transmission of outside forces to the item.

Figure 51:
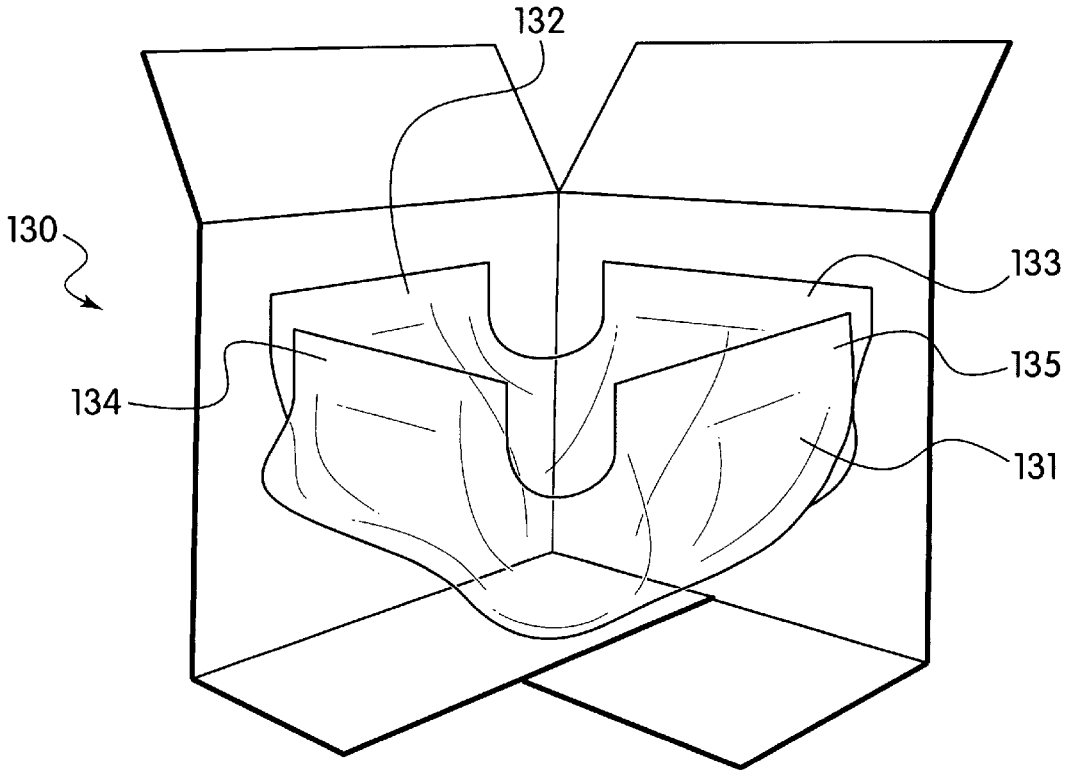
FIG. 51 shows an alterative embodiment in accordance with the invention.
Figure 52:
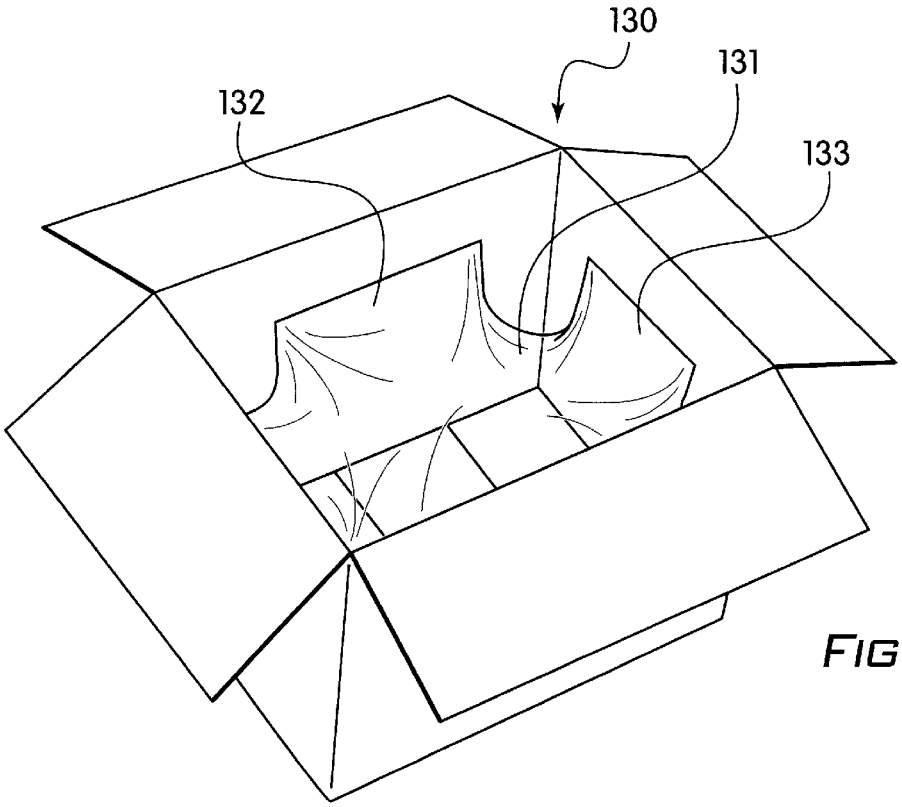
FIG. 52 shows a perspective view of the box of FIG. 51, showing the inside of the box.
Figure 53:
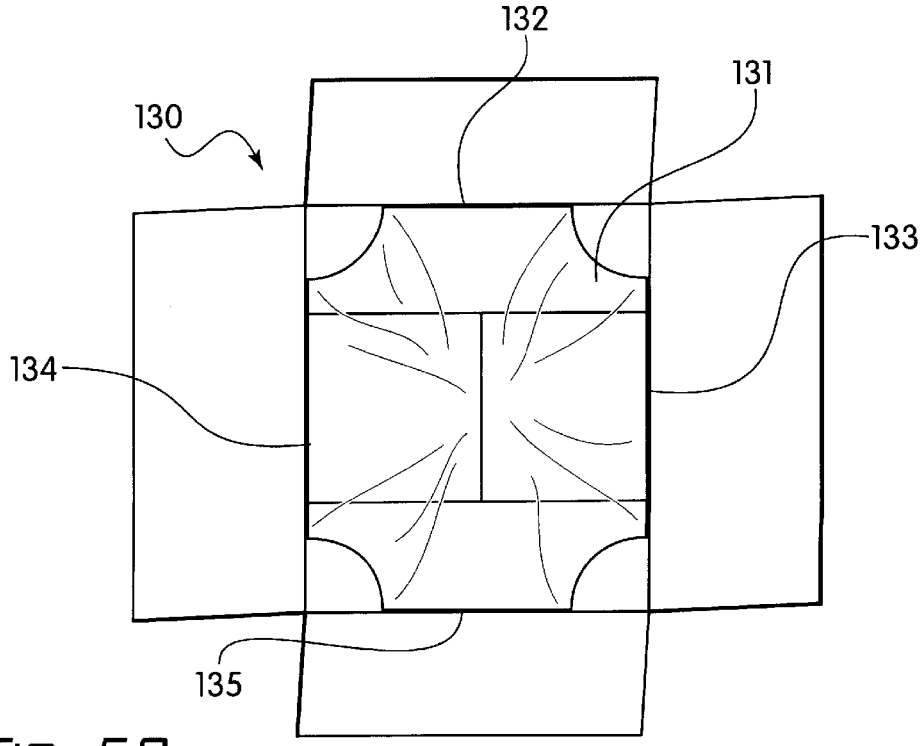
FIG. 53 shows a top view of the box of FIG. 51.

FIGS. 51 through 53 shown an alternative embodiment. The box 130 has within it a resilient element 131 in the form of a bag. The bag is secured to one or more sides of the box, for example at glue strips 132, 133, 134 and 135. Again, this embodiment supports and suspends an item being shipped, to protect it from forces on the outside of the box.

The illustrated and described embodiments are examples only, as there are many other variations within the scope of the invention, as defined by the following claims.

What is claimed is:

1. A box in combination with an insert for the box, wherein the insert comprises:

(a) a relatively rigid sheet, separable into at least first and second panels; and (b) a resilient element attached to each of the first and second panels;

wherein the insert is adapted to be positioned within the box so that at least the first panel of the relatively rigid sheet is at one end of the box and at least the second panel of the relatively rigid sheet is at an opposite end of the box, with the resilient element extending between the first and second panels across the inside of the box to secure an item within the box;

wherein the insert further comprises means for maintaining the position of at least the first panel of the relatively rigid sheet within the box; and wherein the means for maintaining the position of at least the first panel within the box comprises a slot for receiving a lid flap of the box.

2. A box in combination with an insert for the box, wherein the insert comprises:

(a) a relatively rigid sheet, separable into at least first and second panels; and (b) a resilient element attached to each of the first and second panels;

wherein the insert is adapted to be positioned within the box so that at least the first panel of the relatively rigid sheet is at one end of the box and at least the second panel of the relatively rigid sheet is at an opposite end of the box, with the resilient element extending between the first and second panels across the inside of the box to secure an item within the box;

wherein the insert further comprises means for maintaining the position of at least the first panel of the relatively rigid sheet within the box; and wherein the means for maintaining the position of at least the first panel within the box comprises a projection that is received by a slot in a lid of the box.

3. A method of assembling a packaging container comprising the steps of:

(a) providing an insert comprising (i) an integral relatively rigid sheet comprising first and second panels, wherein the relatively rigid sheet is adapted to be separated along separating means such that the first and second panels are then spaced from each other, and (ii) a resilient element attached to each of the first and second panels;

(b) separating the first and second panels of the relatively rigid sheet from each other;

(c) placing the first and second panels inside a box, so that the first panel is positioned at a first end of the box and the second panel is positioned at an opposite end of the box, with the resilient element extending between the first and second panels across the inside of the box to secure an item within the box.

4. The method of assembling a packaging container as recited in claim 3, wherein the first panel comprises means for maintaining the position of the first panel within the box.

5. The method of assembling a packaging container as recited in claim 4, wherein the means for maintaining the position of the first panel within the box comprises a slot for receiving a lid flap of the box.

6. The method of assembling a packaging container as recited in claim 4, wherein the means for maintaining the position of the first panel within the box comprises a projection that is received by a slot in a lid of the box.

7. The method of assembling a packaging container as recited in claim 4, wherein the second panel comprises means for maintaining the position of the second panel within the box.

8. The method of assembling a packaging container as recited in claim 7, wherein the means for maintaining the position of the second panel within the box comprises a slot for receiving a lid flap of the box.

9. The method of assembling a packaging container as recited in claim 7, wherein the means for maintaining the position of the second panel within the box comprises a projection that is received by a slot in a lid of the box.

10. The method of assembling a packaging container as recited in claim 3, wherein the step of placing the first and second panels inside a box further includes positioning the resilient element across the box adjacent to, but distanced from, the bottom of the box, to support an item to be shipped.

11. The method of assembling a packaging container as recited in claim 3, wherein the step of placing the first and second panels inside a box further includes positioning the resilient element across the box adjacent to, but distanced from, the top of the box, to hold down an item to be shipped.

12. The method of assembling a packaging container as recited in claim 3, wherein the integral relatively rigid sheet further comprises at least one side panel adapted to be folded with respect to the first panel and at least one side panel adapted to be folded with respect to the second panel.

13. An insert for positioning inside a box comprising (i) an integral relatively rigid sheet comprising first and second panels, wherein the relatively rigid sheet is adapted to be separated along separating means such that the first and second panels are then spaced from each other, and (ii) a resilient element attached to each of the first and second panels.

14. An insert as recited in claim 13, wherein the first panel comprises means for maintaining the position of the first panel within the box.

15. An insert as recited in claim 14, wherein the means for maintaining the position of the first panel within the box comprises a slot for receiving a lid flap of the box.

16. An insert as recited in claim 14, wherein the means for maintaining the position of the first panel within the box comprises a projection that is received by a slot in a lid of the box.

17. An insert as recited in claim 14, wherein the second panel comprises means for maintaining the position of the second panel within the box.

18. An insert as recited in claim 17, wherein the means for maintaining the position of the second panel within the box comprises a slot for receiving a lid flap of the box.

19. An insert as recited in claim 17, wherein the means for maintaining the position of the second panel within the box comprises a projection that is received by a slot in a lid of the box.

20. An insert as recited in claim 13, wherein the integral relatively rigid sheet further comprises at least one side panel adapted to be folded with respect to the first panel and at least one side panel adapted to be folded with respect to the second panel.

* * * * *